US008104439B2

(12) United States Patent
Kohrs et al.

(10) Patent No.: US 8,104,439 B2
(45) Date of Patent: Jan. 31, 2012

(54) CAMSHAFT ADJUSTER

(75) Inventors: Mike Kohrs, Wilthen (DE); Jens Schafer, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 754 days.

(21) Appl. No.: 12/097,678

(22) PCT Filed: Nov. 28, 2006

(86) PCT No.: PCT/EP2006/068964

§ 371 (c)(1),
(2), (4) Date: Jul. 2, 2008

(87) PCT Pub. No.: WO2007/068576

PCT Pub. Date: Jun. 21, 2007

(65) Prior Publication Data

US 2008/0264365 A1 Oct. 30, 2008

(30) Foreign Application Priority Data

Dec. 15, 2005 (DE) ..... 10 2005 059 860

(51) Int. Cl.
*F01L 1/34* (2006.01)

(52) U.S. Cl. ..... 123/90.15; 123/90.17; 123/90.33; 464/160

(58) Field of Classification Search ..... 123/90.15, 123/90.17, 90.33, 90.44; 464/1, 2, 160
See application file for complete search history.

(56) References Cited

U.S. PATENT DOCUMENTS

| | | | | |
|---|---|---|---|---|
| 6,182,622 | B1 * | 2/2001 | Goloyatai-Schmidt et al. | 123/90.15 |
| 2003/0226534 | A1 | 12/2003 | Watanabe et al. | |
| 2005/0103299 | A1 | 5/2005 | Schafer et al. | |

FOREIGN PATENT DOCUMENTS

| | | |
|---|---|---|
| DE | 10038354 | 2/2002 |
| DE | 10205034 | 8/2003 |
| DE | 10317607 | 11/2003 |
| DE | 10222475 | 12/2003 |
| DE | 10224446 | 12/2003 |
| DE | 10248355 | 4/2004 |
| DE | 102004062035 | 7/2006 |
| DE | 102004062067 | 7/2006 |
| EP | 0715059 | 6/1996 |
| EP | 1043482 | 10/2003 |
| JP | 2001107709 | 4/2001 |
| WO | 03098010 | 11/2003 |

* cited by examiner

*Primary Examiner* — Ching Chang
(74) *Attorney, Agent, or Firm* — Volpe and Koenig, P.C.

(57) ABSTRACT

Traditional camshaft adjusters are connected to a lubricant circuit of an internal combustion engine. Lubricant flows which are too large flood the drive of the camshaft adjuster, which leads to needless churning losses in the drive and needless losses of the pump capacity of the lubricant for other structural components of the internal combustion engine. According to the invention, a flow element (59), which includes a throttle element or screen in the flow channel (26), is used. According to another embodiment of the invention, the throttle element or screen can be used in various ways.

22 Claims, 20 Drawing Sheets

CAMSHAFT ADJUSTER

BACKGROUND

The invention relates to a camshaft adjuster for an internal combustion engine, in which lubrication is performed by means of a lubricant flow.

Camshaft adjusters can be roughly classified as follows:

A. Phase adjusters with a control element, that is, a functional unit, which joins in the mass flow or energy flow formed, for example, hydraulically, electrically, or mechanically and rotates with gear elements of the camshaft adjuster.

B. Phase adjusters with a separate setting element, that is, a functional unit, in which the control parameter required for the control method of the control element is formed from the controller output parameter, and a separate control element. Here, there are the following structural forms:

a. Phase adjusters with a co-rotating actuator and a co-rotating control element, for example, a step-up ratio gear, whose adjustment shaft can be advanced by a co-rotating hydraulic motor or centrifugal force motor and can be reset by a spring.

b. Phase adjusters with a co-rotating control element and a stationary, engine-fixed actuator, for example, an electric motor or an electrical or mechanical brake, see also DE 100 38 354 A1, DE 102 05 034 A1, EP 1 043 482 B1.

c. Phase adjusters with a direction-dependent combination of solutions according to a. and b., for example, an engine-fixed brake, in which part of the brake power is used for adjustments toward an advanced position, in order to tension a spring, which allows resetting after the brake is deactivated, see also DE 102 24 446 A1, WO 03-098010, US 2003 0226534, DE 103 17 607 A1.

In systems according to B.a. to B.c., actuators and control elements are connected to each other by an adjustment shaft. The connection can be switchable or non-switchable, detachable or non-detachable, lash-free or with lash, and flexible or stiff. Independent of the structural form, the adjustment energy can be realized in the form of supply through a drive output and/or brake output, as well as with the use of leakage power of the shaft system (e.g., friction) and/or inertia and/or centrifugal force. Braking, advantageously in the adjustment direction of "retarded" can also be realized under the full use or shared use of the friction power of the camshaft. A camshaft adjuster can be equipped with or without mechanical limiting of the adjustment range. As a gear drive in a camshaft adjuster, one-stage or multiple-stage triple-shaft gears and/or multiple links or coupling gears are used, for example, in structural form as a wobble-plate gear, eccentric gear, planetary gear, undulating gear, cam-plate gear, multiple-link or linked gear, or combinations of the individual structural forms in a multiple-stage construction.

For operation of the camshaft adjuster, a lubricant must be fed to lubricating positions, especially bearing positions and/or rolling toothed sections, wherein the lubricant is used for lubricating and/or cooling components of the camshaft adjuster that can move relative to each other. For this purpose, the camshaft adjuster has a lubricant circuit, which can be coupled, for example, with the lubricant circuit of the internal combustion engine.

SUMMARY

The present invention is based on the object of providing a camshaft adjuster with an improved lubricant circuit.

This objective is met by a device according to the invention. Alternative or cumulative solutions for meeting the objective are described in detail below and in the claims.

The invention is based on the idea that for known camshaft adjusters, the flow rate of the lubricant in the camshaft adjuster is determined by the line cross sections, the pumping capacity of a pump in each operating state, the ambient temperature, and the type of lubricant flow being used and the degree of contamination. The selected flow cross sections, in particular, in the region of the supply and discharge, are defined by production-specific needs. In the operation of the camshaft adjuster, the applicant has determined that a gear drive of a camshaft adjuster, under some circumstances, becomes nearly "flooded" with lubricant, in particular, at high lubricant pressures, if this is provided by the lubricant circuit of the internal combustion engine, and at a low viscosity of the lubricant, for example, at high rotational speeds under high temperature.

In this way, too much energy is lost in the camshaft adjuster due to churning work to be performed. Under some circumstances, the lubricant becomes greatly foamed. Furthermore, due to the large throughput of the lubricant through the camshaft adjuster, the lubricant pressure of the internal combustion engine can decrease, which can result in degraded lubrication of the other paths of the lubricant circuit. Furthermore, a poorer overall efficiency of the internal combustion engine can be produced due to high hydraulic waste power, which can result in increased fuel consumption.

Therefore, the unpublished application of the applicant with the title "Device for changing the control times of an internal combustion engine" from Dec. 23, 2004 with the internal filing number of the applicant of 4626-10-DE proposes to insert a throttle for the lubricant flow in the camshaft adjuster. Such a throttle can be formed by a tooth gap of a crown gear or by grooves running in the radial direction between individual components of the camshaft adjuster.

On the other hand, in the operation of a camshaft adjuster it has been shown that combustion and contamination residue contained in a lubricant of the engine could lead to temporary or permanent functional disruptions in the adjustment mechanism. This can lead to silting or contamination of a gear drive of the camshaft adjuster. Due to the contaminants, increased wear and also increased waste power can be produced due to the contaminant particles in the functional surfaces for the adjustment of the camshaft adjuster.

If one considers providing a diaphragm or a throttle through targeted shaping of the cross sections of the flow channels in the camshaft adjuster, then this requires a complicated production of the cross sections in the region of the throttles or diaphragms. For example, if a diaphragm is to be provided with a small opening cross section, then this requires a diameter jump to a small diameter in the region of the diaphragm, which can be produced by a drill with a small diameter, which is possible only under increased production requirements and the risk of breakage of the drill for rough conditions of use.

Such complicated production possibilities for a diaphragm or a throttle are avoided according to the invention in that, initially, a flow channel of the camshaft adjuster can be produced without a diaphragm or throttle, for example, with a large and/or constant diameter or ring channel. The flow channel thus can be provided with simple production methods and with safe processing. After production of the flow channel, a flow element is inserted into this channel, wherein this element is constructed separate from the components defining the flow channel. The flow element has contours such that a diaphragm or a throttle is created. The contours of the diaphragm or throttle thus can be produced separately from the other components, wherein, for the spatially limited flow element, separate production methods and/or materials can be used. For one construction of the flow element, advantageously the flow element can have through openings in the interior for the diaphragm or throttles and/or can limit a diaphragm or throttle on one side in the region of inner or outer contours, while another limit of the diaphragm or throttle is guaranteed by a component limiting the flow channel.

Through the use of the flow element, under some circumstances, an exchange of the diaphragm or throttle is enabled, because this is inserted into the flow channel and can be removed from this channel again.

On the other hand, increased variability of the flow relationships is given, because, under some circumstances, for different application purposes of the same camshaft adjuster, for basically the same drilling pattern in the construction of the flow channels, different flow elements can be inserted for adapting to different components of the lubricant circuit or the motor oil circuit.

Furthermore, the invention is based on the knowledge that for flow channels with relatively large flow cross sections, with a rise in temperature of the lubricant, the lubricant flow increases exponentially. In contrast, under use of a flow element in the form of a diaphragm or throttle, the influence of the temperature on the lubricant flow decreases or is nearly eliminated for otherwise unchanged flow conditions.

According to another construction of the invention, the flow element is arranged in the inlet region of the lubricant into the gear drive and/or in the outlet region of the lubricant out of the gear drive, so that throttling can be performed selectively in the region of interest. If throttling is already performed in the inlet region of the lubricant, then increased pressures could be withstood due to the throttling of the gear drive, by which the sealing requirements in the gear drive are not increased unnecessarily.

The flow element is, in particular, connected with a positive fit to the flow channel, wherein the flow element can engage in suitable recesses or grooves of the components limiting the flow channel, connected with a friction fit to the flow channel, wherein the flow element is inserted, for example, under an elastic biasing stress, into the flow channel, or connected with a material fit to the flow channel, for example, by an adhesive, wherein combinations of a positive-fit, friction-fit, or material-fit connection are also possible.

Flow elements made from plastic or an elastomer have proven to be advantageous with respect to the flow relationships in the region of the surface, the elastic properties, the chemical interaction with the lubricant, and/or the positive-fit, friction-fit, or material-fit connection to the flow channel.

According to one improvement, the flow channel has, in the region, in which the flow element is inserted, a circular ring-shaped cross section. In contrast to throttles or diaphragms, which are formed in the shape of boreholes with circular cross section, the circular ring-shaped cross sections cannot become blocked as easily due to the increased extent in the circumferential direction, because if need be partial circumferential regions can be added.

In another construction of the invention, a circular ring-shaped cross section for a flow channel can be formed between an outer surface of a central screw screwed into the camshaft on the end face and an inner surface fixed to the camshaft, for example, a hollow shaft or a gear element, so that already present components are used for the flow channel and the surfaces limiting the flow channel can be formed by outer and inner contours of the components with relatively large diameters.

Advantageously, in a camshaft adjuster according to the invention, the flow element is pressed elastically in the radial direction and under radial pressure against a boundary of the flow channel, wherein such pressure can be performed on the inside and/or outside in the radial direction.

Due to the reduced flow cross sections, the throttles or diaphragms form areas raising the risk of overriding blockage with contaminant particles or sludge. This condition can be taken into account according to another embodiment of the invention in that a filter element is arranged upstream of the flow element. Here, the filter element can be arranged upstream of or in the camshaft adjuster. For the case that the filter element is arranged in a flow channel of the camshaft adjuster, the filter element can be constructed separate from the throttle or else as an integral element of the flow element. Furthermore it is to be taken into consideration that the filter element similarly generates a throttling effect, so that a throttle or a diaphragm must be dimensioned under consideration of the throttling effect of the filter element.

Advantageously, the diaphragm or throttle is created by a change in cross section perpendicular to the flow direction of the lubricant. For the case of a circular diaphragm, this means that in the region of the diaphragm, the circular diameter is reduced relative to the other flow cross section. For the case of a circular ring-shaped flow cross section, this means that the radial extent of the circular ring is reduced in the region of the diaphragm or throttle.

In an alternative or cumulative construction of the invention, the diaphragm or throttle is created by a change in cross section in the circumferential direction relative to the flow direction of the lubricant. For example, for one circular ring-shaped cross section through the flow element, the flow cross section is divided into individual circle segments, whose total surface area is smaller than the original circular area of the flow cross section. For a circular ring-shaped flow cross section, for example, the flow element can block individual circumferential areas of the circular ring-shaped flow channel.

Furthermore, the invention proposes to connect several flow elements in series or in parallel. Through the use of a series connection for a path of the lubricant, the area for influencing the flow can be increased. In a parallel connection of several flow elements in different flow paths to different lubricating points, through the same or different flow elements, the lubricant flow at the lubricating points can be selectively influenced corresponding to the requirements at the lubricating point, so that lubricating points with increased lubricant demands can be supplied with more lubricant or the inverse.

According to another solution to meet the objective forming the basis of the invention, the flow of lubricant is influenced by a flow element, whose flow properties can be changed during the operation of the internal combustion engine. In this way, the flow element can be constructed as an integral component of the flow channel or as a separate flow element, as described above. By changing the flow properties, a change in the lubricant flow, for example, due to the lubricant heating up can be counteracted. On the other hand, by changing the flow properties of the flow element, it is possible to selectively change the pressure, the velocity, and the lubricant flow in the region of the lubricating point or in the feeding area to this lubricating point, if there is increased or decreased lubricant and/or cooling requirements due to changed operating conditions, so that the individual operating conditions can be better taken into account.

A change in the flow element due to the influence of the flow properties can take place automatically, for example, in the form of a thermocouple or in the form of mechanically self-correcting solutions. The use of an adjustment device for changing the flow element is also possible, wherein this adjustment device is acted upon by a suitable control or regulating device.

In another construction of the camshaft adjuster according to the invention, the flow element can be temporarily closed completely. Such a flow element can be closed completely, for example, when the engine is stopped. Also possible is a repeated closing of the flow element during operation, which can generate pulses in the lubricant, which can, under some circumstances, reinforce a targeted lubrication and cooling effect and which can increase the area covered by the lubricant.

Furthermore, it is possible that the flow properties of the flow element can be changed in a motion-controlled way by rotating the camshaft, the camshaft adjuster, or the gear drive. For example, the centrifugal force of the flow properties of the flow element can be regulated with the rotation of the camshaft. In an alternative construction, in the feeding area between two boreholes of components that can move relative to each other, for example, the cylinder head and the camshaft, by which a lubricant transfer is guaranteed, the transfer cross section can be guaranteed only in select relative positions, while for other relative positions, the transfer cross section is closed partially and/or completely, so that the lubricant can be transferred only intermittently.

Another solution for meeting the objective forming the basis of the invention takes advantage of an already existing hollow cylinder-shaped intermediate space, which is arranged between a central screw and a recess of the camshaft and in which a first partial region of this intermediate space forms a first flow channel, wherein the manufacturing dimensions for the outer diameter of the central screw and the inner diameter of the recess define the gap height of the ring-shaped flow channel. In an outer second partial region of the intermediate space there is a hollow shaft, which forms a second flow channel on the outside and/or inside in the radial direction. Due to the dimensions of the hollow shaft, the second flow channel is equipped with a smaller flow cross section than the first flow channel. An additional throttle or diaphragm is created in such a way that in the transfer cross section between the first flow channel and the second flow channel there is a projection, for example, the central screw, the hollow shaft, or the camshaft, or an additional component, which again reduces the second flow channel in this region and thus creates a throttle or diaphragm. This represents an especially simple realization for a diaphragm or throttle, which uses the already existing components and allows the production of the diaphragm or throttle with small opening cross section with nevertheless large dimensions of the involved components.

For another solution to meet the objective forming the basis of the invention, in the intermediate space named above there is a radial groove in the camshaft. In this case, a diaphragm is created in such a way that the transfer cross section from the first partial region to the radial groove is partially closed by an end face of the hollow shaft similarly arranged in the intermediate space. In this case, the diaphragm can be realized without the necessity of manufacturing small opening cross sections through a borehole of small diameter or the like by shaping the central screw and the recess of the camshaft and also the groove and the hollow shaft.

A multi-functional use of the groove is then given when the groove has an outer dead space in the radial direction, in which particles can be deposited due to a centrifugal force exerted on the lubricant.

Another solution to meet the objective forming the basis of the invention involves the transfer of the lubricant from a cylinder head-fixed component, for example, a camshaft bearing, to the camshaft. For such transfer, the cylinder head-fixed component has at least one outlet opening, from which the lubricant enters into at least one inlet opening of the camshaft. In this case, in a simple way—without the need for manufacturing a throttle or diaphragm with a small borehole diameter, a small groove width, or the like, a throttle or diaphragm can be created in such a way that the inlet opening of the camshaft and the outlet opening of the cylinder head-fixed component do not align with each other, so that the transfer cross section is given by the larger cross section of the inlet opening and the outlet opening, but instead the inlet opening and the outlet opening are arranged offset relative to each other, so that the opening cross section of the diaphragm is given by the only partial overlap of the inlet opening and the outlet opening. Such an offset involves, for example, an offset of the inlet opening and outlet opening in the circumferential direction and/or an axial offset in the direction of the longitudinal axis of the camshaft.

Such a construction is then also possible when the inlet opening or the outlet opening is constructed as a groove running partially or completely in the circumferential direction, while the other opening is constructed as a borehole.

Advantageously, the measures according to the invention are used for a camshaft adjuster in a construction with a wobble plate gear.

Advantageous improvements of the invention emerge from the claims, the description, and the drawings. The advantages named in the introduction of the description for features and combinations of several features are merely examples, without these having to be necessarily realized by embodiments according to the invention. Additional features are to be taken from the drawings—in particular, the illustrated geometries and the relative dimensions of several components to each other, as well as their relative arrangement and effective connection. The combination of features of different embodiments of the invention or of features of different claims is similarly possible deviating from the selected associations of the claims and is suggested with this reference. This also relates to features that are shown in separate drawings or are named in their description. These features can also be combined with features of different claims. Likewise, features listed in the claims can be left out for other embodiments of the invention.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

In the figures, components that correspond with respect to form and/or function are to some extent provided with the same reference symbols.

Figure 1:
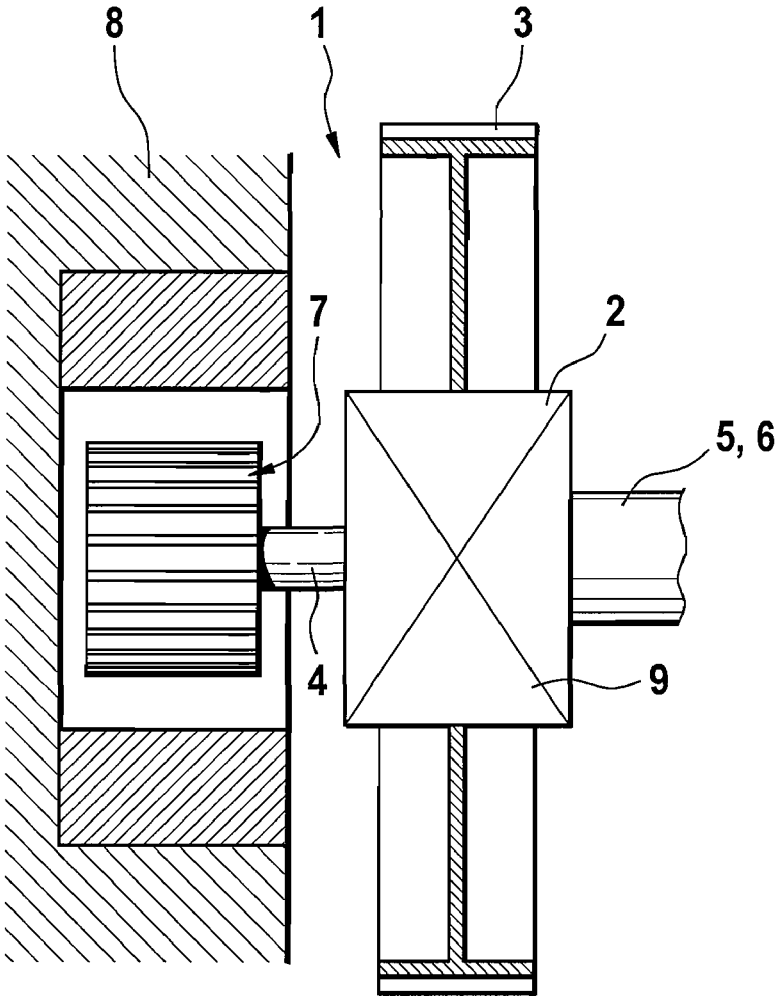
FIG. 1 a schematic diagram of a camshaft adjuster.

FIG. 1 shows in a schematic diagram a camshaft adjuster 1, in which, in a gear drive 2, the movements of two input elements, here a drive wheel 3 and an adjustment shaft 4 (also called wobble plate), are superimposed on an output movement of an output element, here a driven shaft 5 locked in rotation with a camshaft or the camshaft 6 directly. The drive wheel 3 is in drive connection with a crankshaft of the internal combustion engine, for example, via a traction element, such as a chain or a belt, or a suitable toothed section, wherein the drive wheel 3 can be formed as a chain or belt wheel.

The adjustment shaft 4 is driven by an electric motor 7 or is in active connection with a brake. The electric motor 7 is supported relative to the surroundings, for example, the cylinder head 8 or another engine-fixed part.

Figure 2:
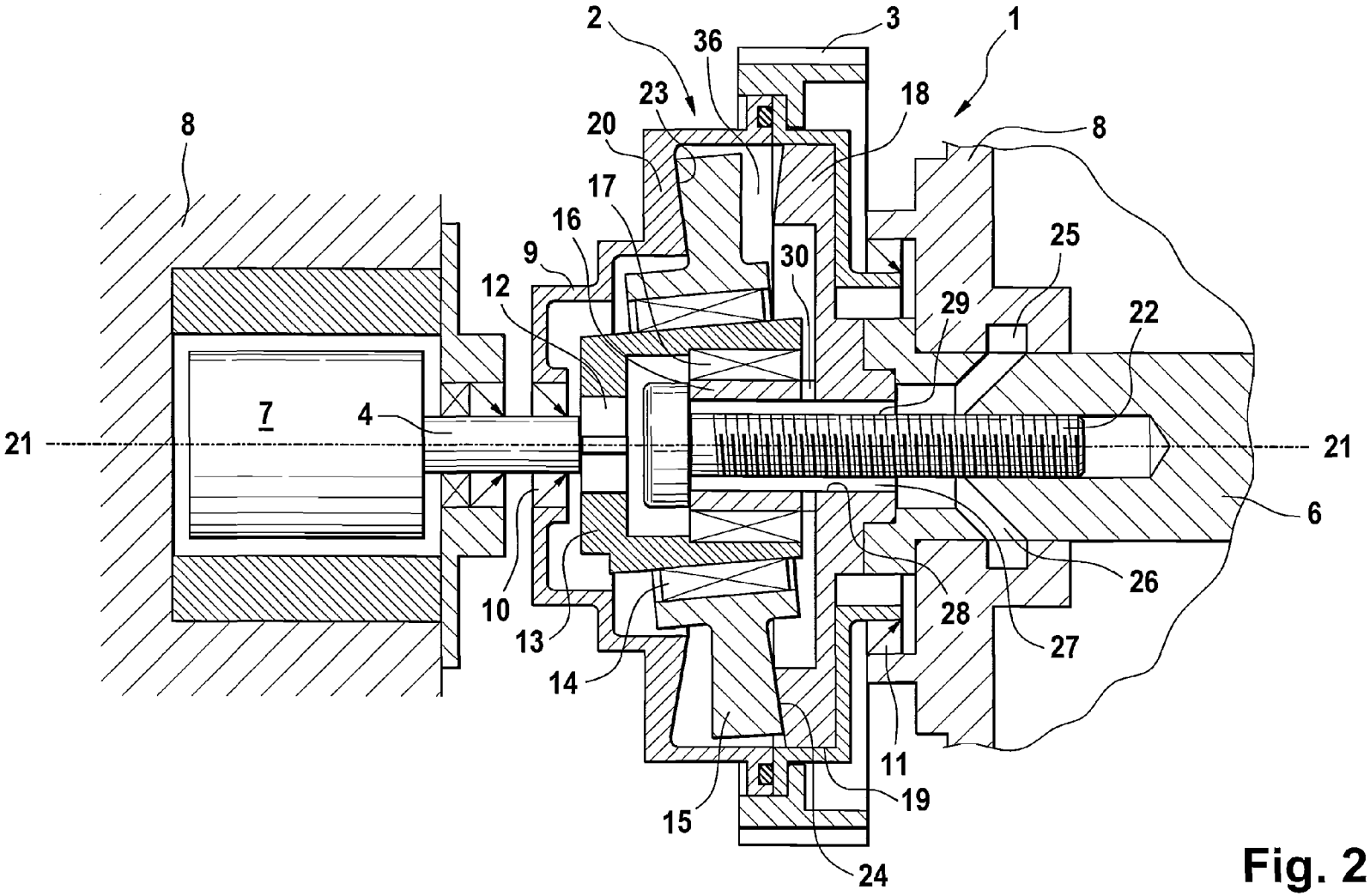
FIG. 2 a schematic diagram of a camshaft adjuster with a wobble-plate gear.

FIG. 2 shows an exemplary construction of a camshaft adjuster 1 with a gear drive 2 with a wobble-plate construction. A housing 9 is locked in rotation with the drive wheel 3 and is sealed in an axial end region by a sealing element 10 relative to the adjustment shaft 4. In the opposite axial end region, the housing 9 is sealed with a sealing element 11 relative to the cylinder head 8. An end region of the camshaft 6 projects into an inner space 36 formed by the housing 9 and the cylinder head 8. Arranged in the inner space are furthermore, an eccentric shaft 13 connected via a coupling 12 to the adjustment shaft 4, a wobble plate 15 supported by a bearing element 14, for example, a roller bearing, and a hollow shaft 16, which is supported by a bearing element 17, for example, a roller bearing, on the inside in a central recess of the eccentric shaft 13 and carries a driven conical gear wheel 18. The driven conical gear wheel 18 is supported by a bearing 19 relative to the housing 9. In the interior, the housing 9 forms a drive conical gear wheel 20. The wobble plate 15 has suitable toothed sections on opposite end faces. The eccentric shaft 13 with the bearing element 14 and wobble plate rotates about an axis inclined relative to a longitudinal axis 21-21, so that the wobble plate meshes on partial-regions offset in the peripheral direction relative to each other, on one hand, with the drive conical gear wheel 20 and, on the other hand, with the driven conical gear wheel 18, wherein a step-up or step-down ratio is given between the drive conical gear wheel and driven conical gear wheel. The driven conical gear wheel 18 is locked in rotation with the camshaft 6.

For the embodiment shown in FIG. 2, the hollow shaft 16 with the driven conical gear wheel 18 is connected via a central screw 22, which extends through the hollow shaft 16, to the camshaft 6 on the end. Lubrication with a lubricant, especially oil, is necessary in the region of the lubricating positions 23, 24, which can involve, for example, the contact surfaces between the drive conical gear wheel 20 and wobble plate 15, the contact surface between the wobble plate 15 and driven conical gear wheel 18, the bearing 19, bearing element 14, and/or bearing element 17.

Here, a continuous, cyclical, pulsing, or intermittent feed and/or forwarding of a lubricant via the lubricant channels is realized. Through the use of a feed recess 25 of the cylinder head 8, the lubricant is fed to a flow channel 26 of the camshaft 6, which communicates with a flow channel 27, which is formed with a hollow cylindrical shape between an inner casing surface 28 of the hollow shaft 16 and an outer casing surface 29 of the central screw 22. Through the use of radial boreholes 30 of the hollow shaft 16, the lubricant can emerge from the flow channel 27 outward in the radial direction and can be fed to the lubricating positions.

Figure 3:
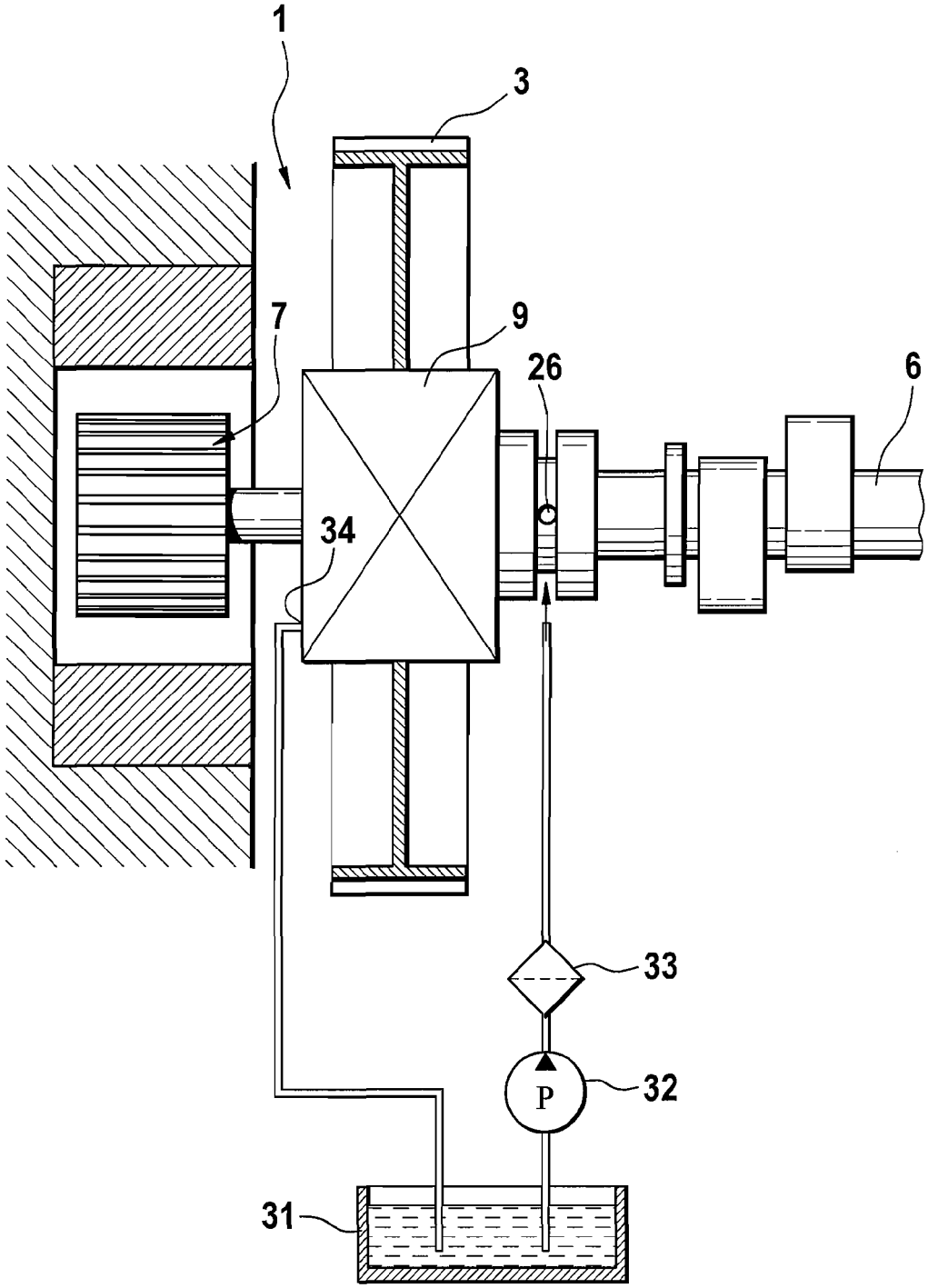
FIG. 3 a camshaft adjuster in a schematic diagram with a lubricant circuit.

FIG. 3 shows a schematic lubricant circuit. The lubricant is fed from a reservoir 31, for example, an oil pan or an oil tank, via a pump 32, for example, a motor-oil pump, through a filter 33, in particular, a motor-oil filter, to the supply recess 25 and the flow channel 26 of the camshaft 6. The lubricant leaves the camshaft adjuster 1 or the housing 9 of the camshaft adjuster via an outlet opening 34 and is fed back into the reservoir 31.

Figure 4:
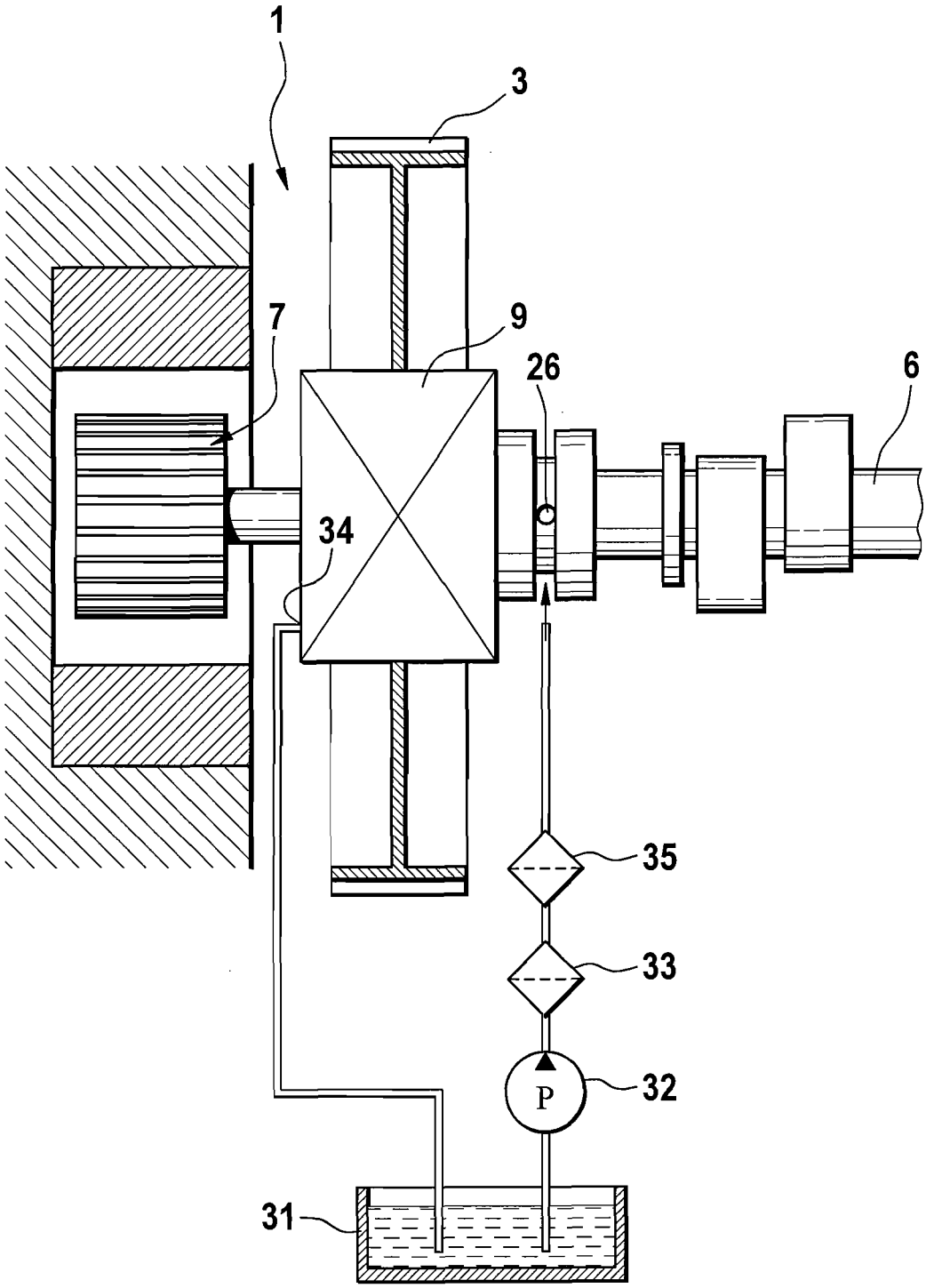
FIG. 4 a camshaft adjuster in a schematic diagram with a lubricant circuit, in which a filter element is integrated, FIG. 5 a semi-longitudinal cross-sectional view of a camshaft adjuster with a dead space for the deposition of contaminant particles, FIG. 6 a schematic diagram of a camshaft adjuster with a lubricant circuit, which is equipped both on the input side and also on the output side with a throttle and a diaphragm, FIG. 7 a longitudinal cross-sectional view of a camshaft adjuster with guidance of the lubricant into a flow channel, FIG. 8 a longitudinal cross-sectional view of a camshaft adjuster, in which two diaphragms are connected one after the other in a flow channel, FIG. 9 a longitudinal cross-sectional view of a camshaft adjuster with a flow element, which is set on a central screw and which forms a diaphragm with an inner casing surface of the camshaft, FIG. 10 a longitudinal cross-sectional view of a camshaft adjuster with a diaphragm formed between a hollow shaft and a central screw, FIG. 11 a longitudinal cross-sectional view of a camshaft adjuster with the feeding of a lubricant via a transfer cross section from an outlet opening of the cylinder head to an inlet cross section of the camshaft, FIG. 12 a longitudinal cross-sectional view of another construction of a lubricant feed to a camshaft and to a camshaft adjuster, FIG. 13 a longitudinal cross-sectional view of another construction of a lubricant feed to a camshaft and to a camshaft adjuster, FIG. 14 a longitudinal cross-sectional view of another construction of a lubricant feed to a camshaft and to a camshaft adjuster, FIG. 15 a longitudinal cross-sectional view of another construction of a lubricant feed to a camshaft and to a camshaft adjuster, FIG. 16 a longitudinal cross-sectional view of a camshaft adjuster with different examples for an arrangement of diaphragms or throttles for influencing the flow of a lubricant, FIG. 17 a perspective view of a camshaft adjuster with openings of a housing of the gear drive for passage of the lubricant in the form of droplets, lubricant mist, or sprayed lubricant, FIG. 18 another perspective view of the camshaft adjuster according to FIG. 17 with other options for openings, FIG. 19 a view of a camshaft adjuster in the installed state with options for lubrication via droplets, a lubricant mist, and/or sprayed lubricant, and FIG. 20 a side view of a camshaft adjuster in the installed state with a drop plate, on which droplets of an oil mist settle and drop in the direction of the interior of the camshaft adjuster.

In contrast to the embodiment according to FIG. 3, the schematic lubricant circuit according to FIG. 4 has an additional filter element 35. The filter element 35 is advantageously allocated to the camshaft adjuster 1 and is arranged, for example, after a branch of the lubricant circuit to other components to be lubricated and allocated exclusively to the branch of the lubricant circuit that is used for lubricating the camshaft adjuster. Here, the filter 35 is arranged as close as possible to the installation position of the camshaft adjuster 1 or in the camshaft adjuster itself. The filter element 35 can be used to keep processing residue in the flow channels, which are arranged upstream of the filter element 35, away from the flow channels of the cylinder head and the camshaft. Furthermore, fabrication residue and contaminant particles in the lubricant can be kept away from the gear drive 2 of the camshaft adjuster 1. Furthermore, a diaphragm characteristic or a throttle effect of the filter element 35 can be used selectively, in order to influence the pressure, the volume flow, and the velocity of the lubricant. The filter element 35 is advantageously to be implemented in such a way that it cannot become blocked or clogged due to the flow relationships at the maximum contamination to be expected with particles and contaminants during the runtime of the camshaft adjuster. For example, the arrangement in a rising line and/or as a secondary current filter is advantageous.

The filter element 35 can be constructed, e.g., as
a screen,
a ring filter,
a plug-in filter,
a shell filter,
filter plates,
filter net, or
sintered filter.

Figure 5:
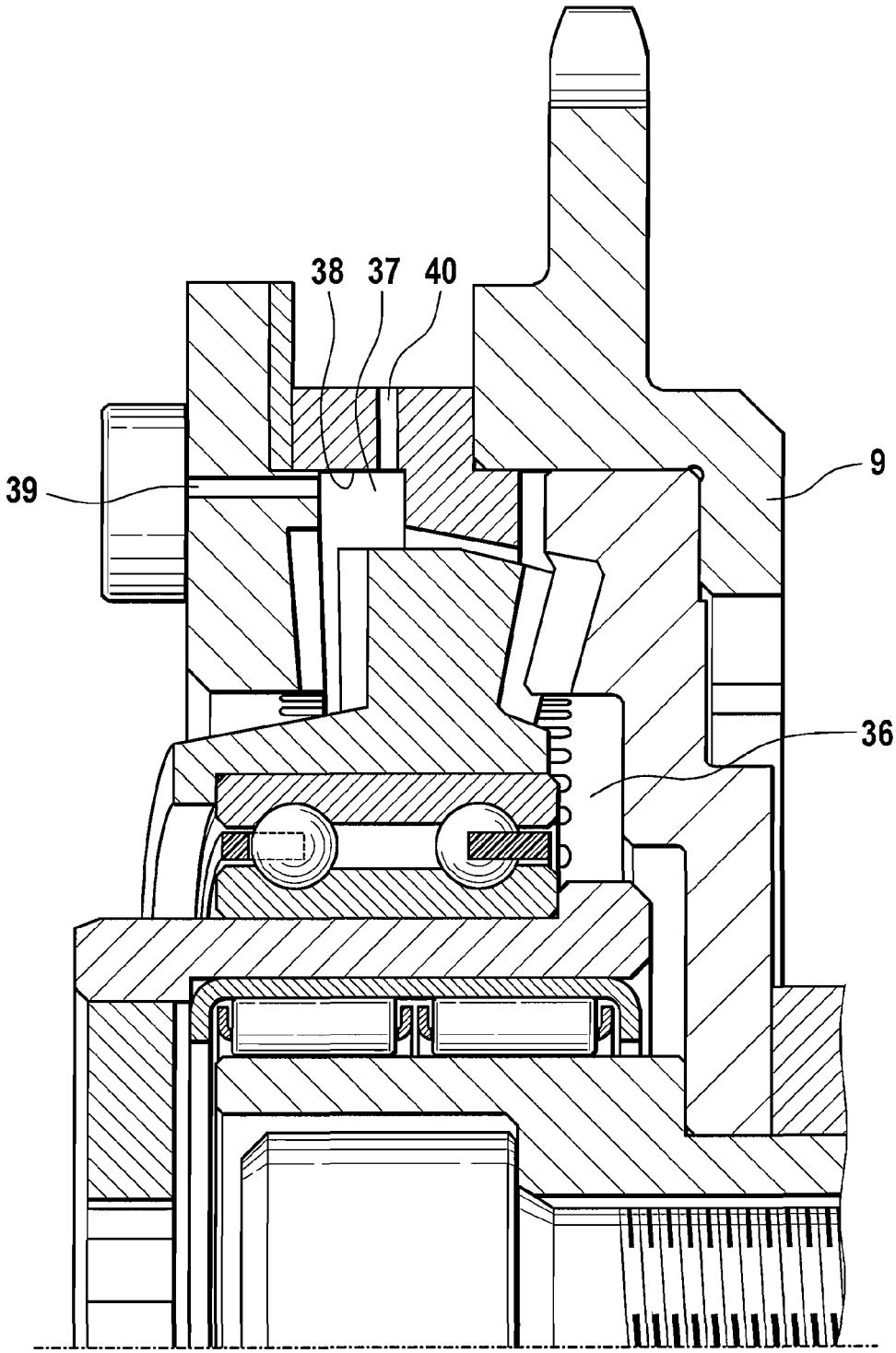

According to FIG. 5, lubricant is fed into an inner space 36 of the housing 9, for example, according to the embodiments described above, wherein, in the inner space 36, the lubricant comes into contact with the lubricating positions. The inner space 36 is in lubricant connection with a dead space 37, which is arranged at a position of the inner space 36 farthest removed in the radial direction. A connection of the dead space 37 to the inner space 36 can be formed over a large surface via transfer cross sections or via separate channels, by which lubricant can be fed to and also discharged from the dead space 37.

For the embodiment shown in FIG. 5, the dead space 37 is constructed as a surrounding ring channel. A dead space 37 involves, in particular, a space, in which the lubricant moves with minimal velocity or is almost at rest, so that the dead space 37 is not arranged in a direct, maximum flow-through zone of the lubricant. In the dead space 37, due to the rotation of the housing 9, the lubricant is exposed to a centrifugal force, by which heavy components and particles suspended in the lubricant are pressed outward and can be deposited on a wall 38 on the outside in the radial direction and are not led back to a lubricating position. It is further possible that the annular dead space 37 is separated in the peripheral direction by intermediate walls, so that, in the peripheral direction, several individual chambers are formed, by means of which it is avoided that in the dead space 37, the lubricant can move in the peripheral direction relative to the housing 9. Settling of contaminants is thus realized analogous to a rotating centrifuge.

Dead spaces according to the dead space 37 can be arranged at any position in the gear drive, as well as in the region of the camshaft, by which it can be achieved that important functional surfaces, for example, in the direct neighborhood of the dead spaces, are not "silted up" due to centrifuged contaminants in the gear drive. The centrifugal effect is amplified by an increase in the distance of the dead spaces from the longitudinal axis 21-21.

According to a first construction, the dead space has no additional outflow, so that centrifuged contaminant particles are deposited permanently in the dead space 37. According to the preferred construction shown in FIG. 5, the dead space has at least one additional outlet opening 39, 40, wherein the outlet opening 39 is oriented in the axial direction and the outlet opening 40 is oriented in the radial direction. Due to the radial centrifugal force and/or the pressure ratios in the dead space 37 in comparison with the surroundings of the camshaft adjuster 1, the lubricant with deposited contaminant particles moves in the radial direction out of the outlet opening 40, wherein the feeding of the contaminant particles is supported by the centrifugal effect. Alternatively, feeding through the outlet opening 39 is realized exclusively through the pressure difference in the dead space 37 on one side and in the surroundings of the camshaft adjuster 1 on the other side.

For an alternative construction, contaminants are separated in such a way that the lubricant is guided in a flow channel with a labyrinth-like or zigzag-shape construction. Contaminant separation through such a labyrinth-like contaminant separator touches upon the different inertia of the lubricant and interfering particles in the lubricant. In particular, for high flow rates, a strong deflection of the lubricant flow can lead to the result that the particles are not deflected, but instead are deposited at the borders of the labyrinth. For the case that individual channels of the labyrinth are oriented in the radial direction, deposition in the labyrinth on surfaces on the outside in the radial direction can take place in such channels, as well as similarly in axial channels, due to the centrifugal force described above. An alternative or additional separating effect can be produced when the lubricant is decelerated and accelerated, wherein the lighter lubricant can be accelerated more easily, while contaminant particles remain behind.

In additional to generating the centrifugal effect due to rotation of the housing 9 or other parts of the camshaft adjuster 1, the centrifugal effect can be generated at least partially in such a way that the flow channels guiding the lubricant are oriented in a circular or spiral construction, so that a deposit can form on the outer boundaries of the flow channels just due to the movement of the lubricant through the curved flow channels.

Figure 6:
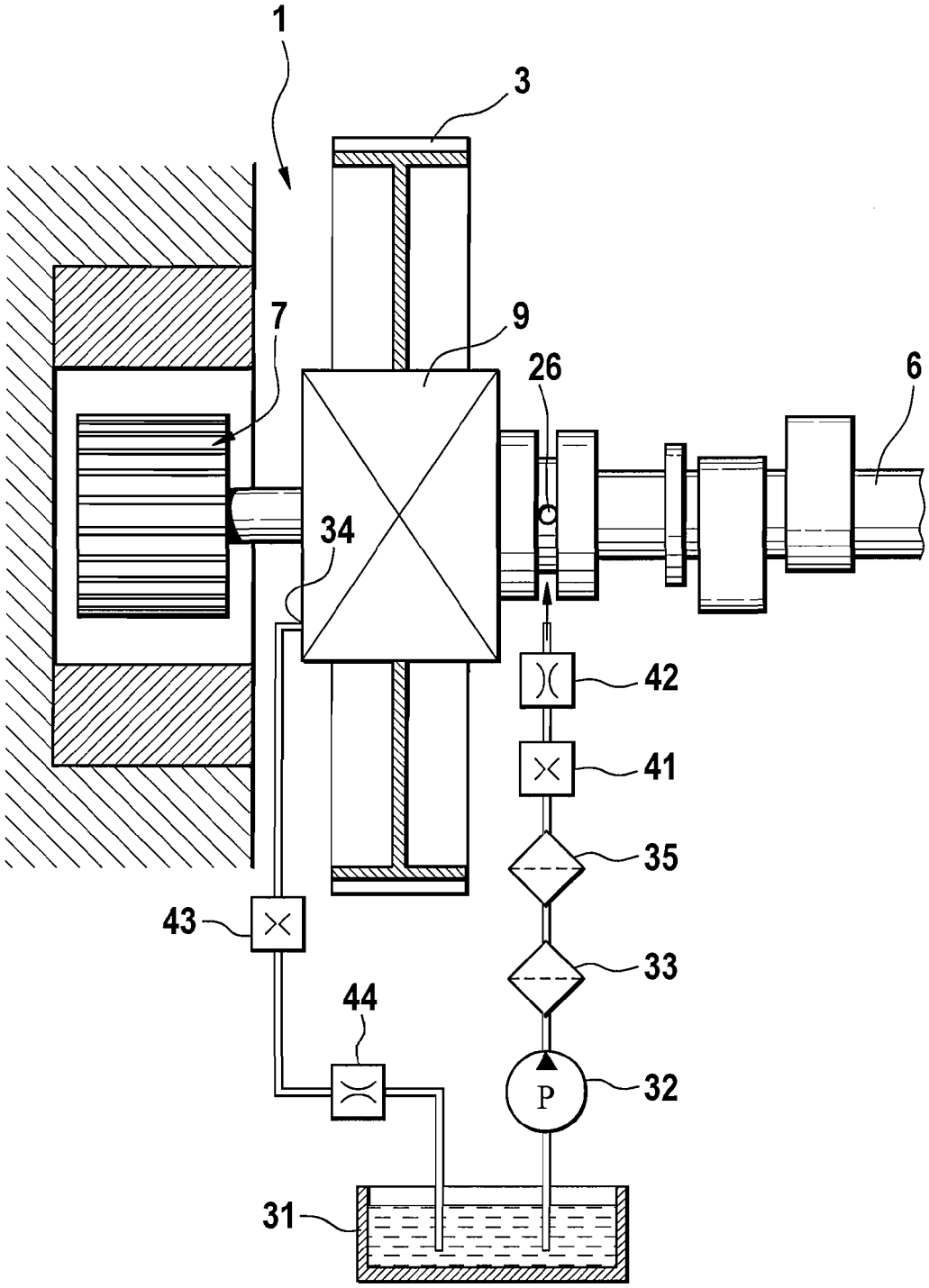

Deviating from the embodiments shown in FIGS. 3 and 4 for a lubricant circuit, the schematic lubricant circuit shown in FIG. 6 has an input-side diaphragm 41 and also an input-side throttle 42 and an output-side diaphragm 43 and also an output-side throttle 44. The diaphragms 41, 43 and throttles 42, 44 form flow elements for influencing the flow ratios in the lubricant circuit. The flow elements noted above are allocated to a parallel lubricant path, which applies a force exclusively to the camshaft adjuster 1. Advantageously, the flow elements are arranged close to the camshaft adjuster 1 or are integrated at least partially into this adjuster, the camshaft, or a cylinder head in the region of a bearing position for the camshaft.

Through the use of the diaphragms 41, 43 and throttles 42, 44, the volume flow to the camshaft adjuster is throttled. Additional throttling can be produced through the use of the filter element 35. Advantageously, the filter element is arranged in the flow direction upstream of the flow elements, so that the flow elements do not become blocked by particles or clogged over the course of time.

In addition to the use of flow elements with constant flow characteristics, a flow element that is continuous or that can be changed in steps can be used. The use of a flow element, whose flow effect is variable
as a function of an engine rotational speed,
coupled with a feeding volume of the pump 32, and/or
as a function of the temperature of the camshaft adjuster 1 or the lubricant is possible, wherein the mentioned changes can be generated automatically in a mechanical way or by a suitable control or regulating device, which acts on the flow element.

The flow element is changed in such a way that, for example, the volume flow of the lubricant is held to a constant value independent of the temperature of the lubricant. It is also possible that the volume flow is increased or decreased due to an effect of the flow element in operating regions, in which there are higher or lower lubricant or cooling requirements.

For the construction of the flow elements in the form of throttles 42, 44 and diaphragms 41, 43, under some circumstances, embodiments are to be used, in which ring gaps or annular cross sections are used instead of boreholes with, for example, a circular cross sectional surface, because, under some circumstances, a borehole can be more easily blocked than a ring gap.

Figure 7:
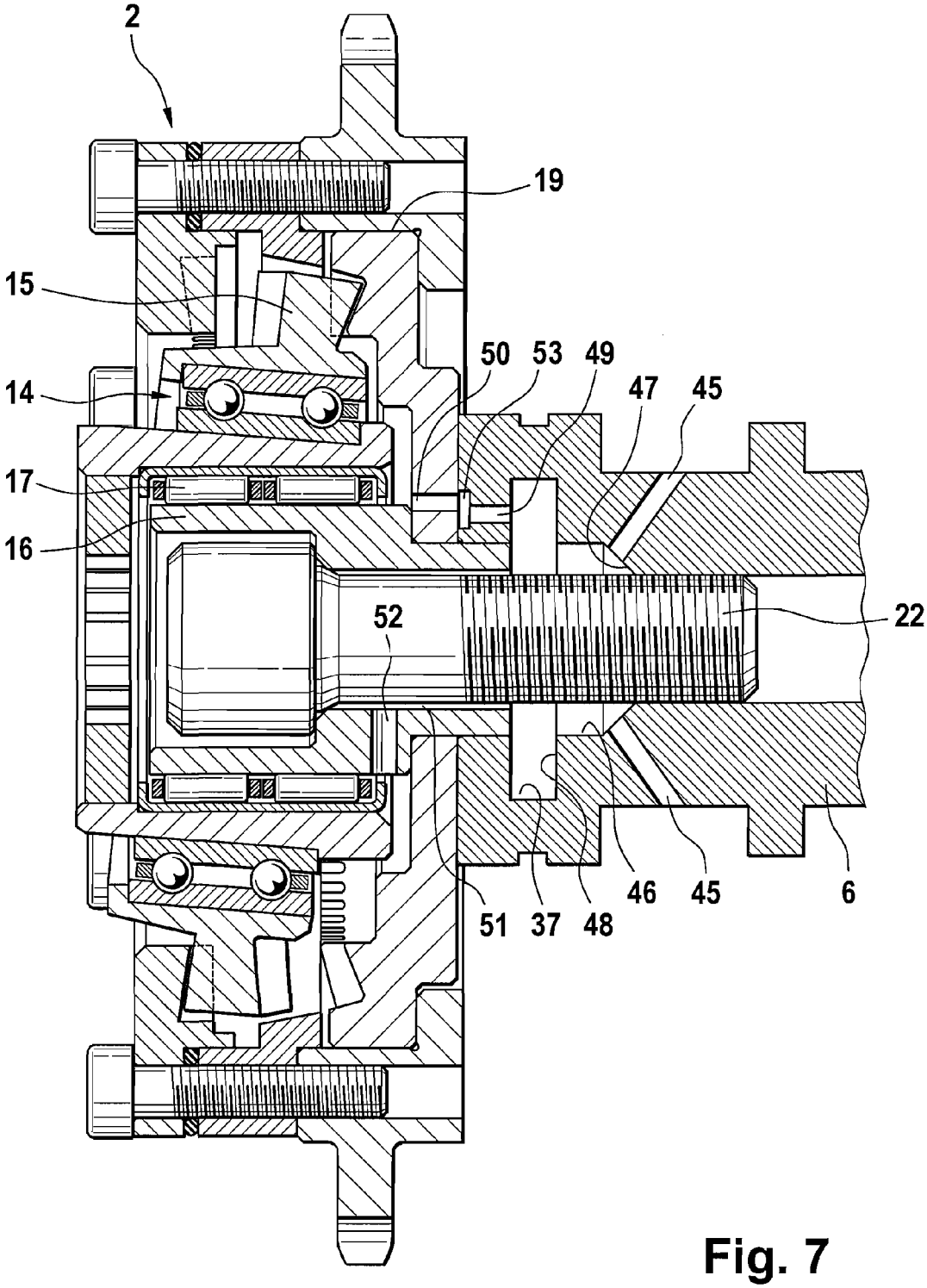

For the embodiment shown in FIG. 7, lubricant is fed via several boreholes 45 of the camshaft 6, wherein the boreholes 45 are inclined relative to the longitudinal axis 21-21 and the radial orientation. The camshaft 6 has an end-face blind borehole 46, which transfers with a conical chamfer 47 into a thread for receiving the central screw 22. The boreholes 45 open into the chamfer 47. In the end region opposite the chamfer 47, the boreholes 45 are fed with lubricant from a supply groove of the cylinder head 8. A groove 48 surrounding in the radial direction is formed with the rectangular geometry shown in the longitudinal section approximately in the center in the borehole 45.

One part of the lubricant fed to the groove 48 via the borehole 45 and borehole 46 is led via an axial borehole 49 of the camshaft 6, which opens into the groove 48, and an axial borehole 50 of the housing 9 with a certain amount of overlap, but offset in the radial direction, in the inner space of the gear drive 2 to the lubricating positions, for example, to the bearing element 17, the bearing element 14, the rolling toothed connections of the wobble plate 15, and/or the bearing 19.

The other part of the lubricant fed to the groove 48 is led via a flow channel 51 with a circular ring-shaped cross section and formed between the inner casing surface of the hollow shaft 16 and the outer casing surface of the central screw 22 to at least one radial borehole 52 to a lubricating position, for example, the bearing position 17 or in the inner space of the gear drive 2. The groove 48 is constructed with a radial projection, which extends over the borehole 49, so that a peripheral, ring-shaped dead space 37 is formed on the outside in the radial direction. Between the boreholes 49, 50, a transfer region 53 can be formed in the shape of a recess, a radial groove, or the like, in order to allow transfer between the boreholes 49, 50 that are offset relative to each other in the radial direction. In the form of the boreholes 49, 50 that are not aligned with each other, for a partial overlap of the boreholes, a kind of diaphragm can be formed with a small transfer cross section or diaphragm cross section, although the boreholes 49, 50 can be produced with relatively large diameters and thus with rough tools.

Figure 8:
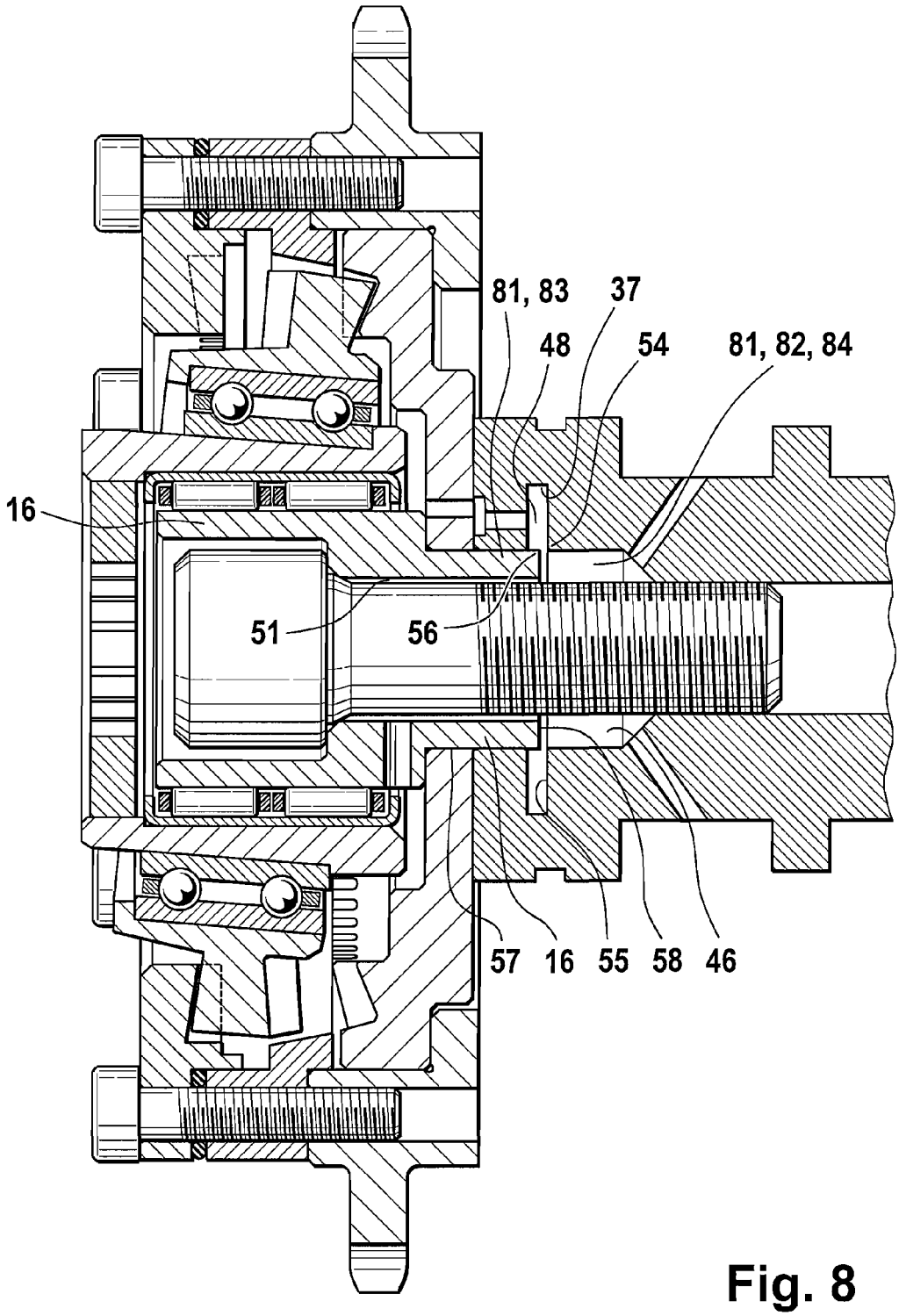

For a construction that otherwise corresponds to FIG. 7, for the embodiment shown in FIG. 8, the extent of the hollow shaft 16 in the longitudinal direction lengthens in such a way that the hollow shaft projects into the groove 48. A diaphragm for transfer of lubricant from the borehole 46 to the groove 48 is formed between a peripheral edge 54, which is formed by the inner casing surface of the borehole 46 and also a transverse surface 55 defining the groove, and an edge 56, which is formed by the outer casing surface 57 of the hollow shaft 16 and an end face 58 of the hollow shaft 16.

For a construction that otherwise corresponds to the embodiments described above, the camshaft 6 according to FIG. 9 has no groove 48. The boreholes 49, 50 and the transfer region 53 are also not provided for the embodiment according to FIG. 9, so that the lubricant is fed from the borehole 46 completely to the flow channel 51. In the circular ring-shaped flow channel, which is formed in the borehole 46 and which has a rectangular half cross section and which is defined on the inside in the radial direction by the casing surface of the central screw 22 and also by an end face 58 of the hollow shaft 16, there is a flow element 59, which can involve a ring made from, for example, plastic or an elastomer, and covered by the central screw 22. For the embodiment shown in FIG. 9, the flow element 59 has an approximately T-shaped half longitudinal cross-section, wherein the transverse leg of the T contacts the casing surface of the central screw 22 under elastic pressure on the inside in the radial direction, while the vertical leg of the T extends outward in the radial direction and the end face of this leg forms a ring gap 60 with the borehole 46, by which a diaphragm is created.

In a modified construction, the flow element 59 can be tensioned outward, for example, in the radial direction against the borehole 46, wherein, in this case a ring gap 60 is formed between the inner surface of the flow element and the central screw. Also, a positive-fit holding of the flow element 59, for example, in a suitable groove of the camshaft or the central screw, is conceivable. An arbitrary construction of the contours of the flow element 59 in the region of the ring gap 60 is possible for influencing the flow ratios, for example, with stepped transitions or continuous transitions.

Figure 10:
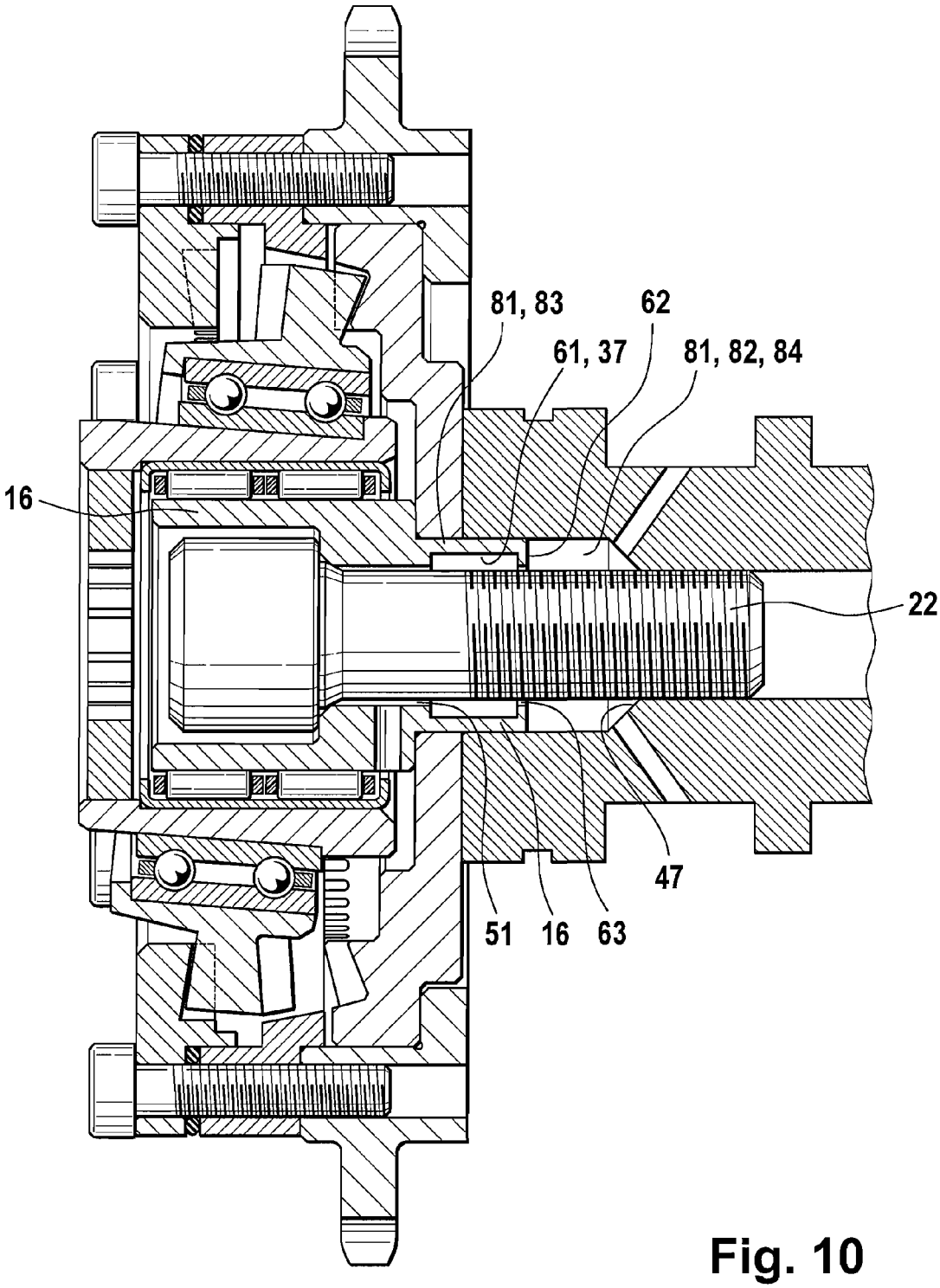

For the embodiment shown in FIG. 10, the hollow shaft 16 has in the region of the flow channel 51 a radial, peripheral groove 61, which is defined on the side facing the chamfer 47 by a peripheral, radial projection 62 pointing inwardly in the radial direction. Between the projection 62 and the casing surface of the central screw 22, a ring gap 63 is formed, which represents a diaphragm. The groove 61 forms a dead space 37 on the outside in the radial direction, because both the ring gap 63 and also the flow channel 51 open into the groove 61 on the inside in the radial direction from the dead space 37.

Figure 11:
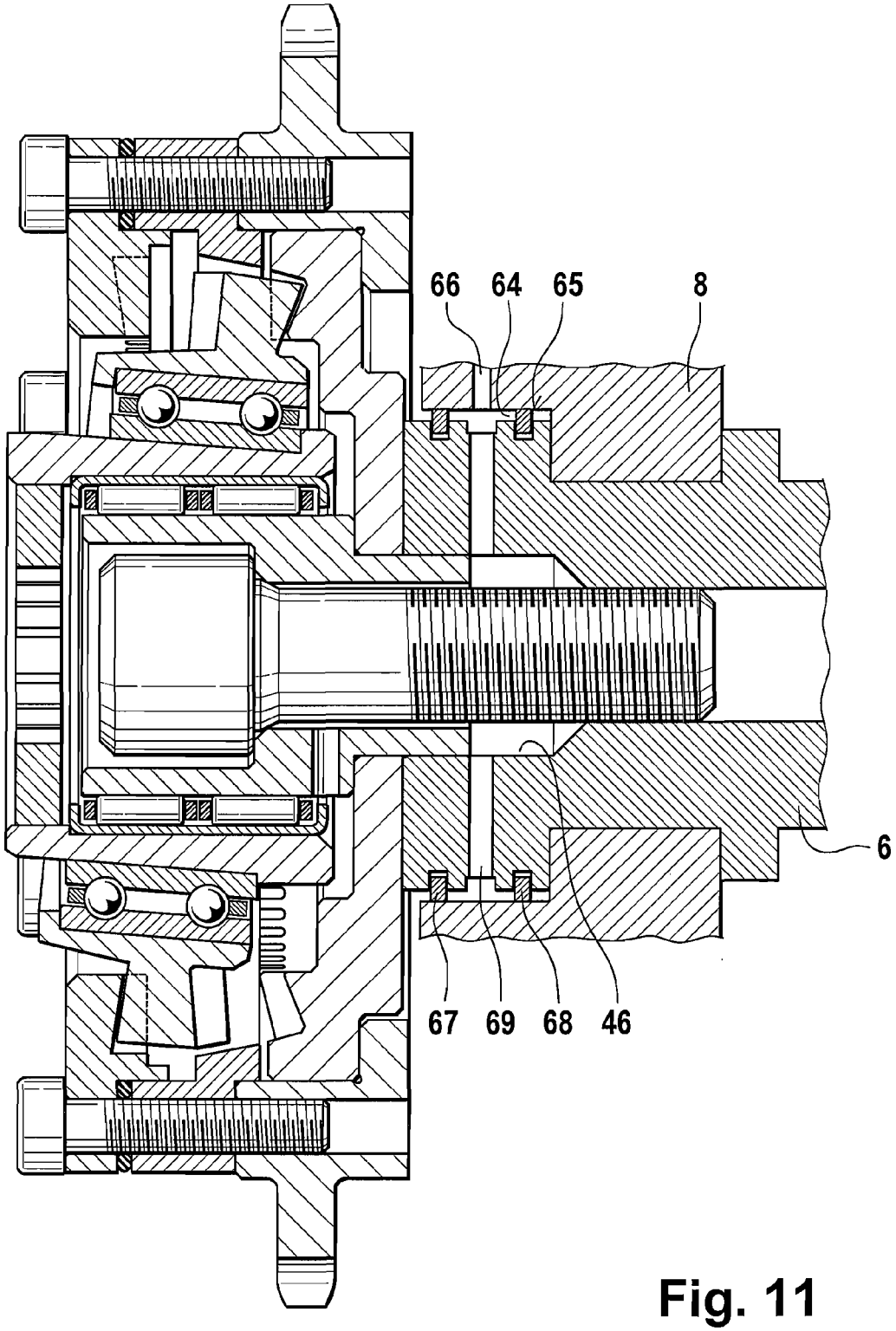

The camshaft 6 is supplied with a lubricant from a lubricant gallery of the cylinder head 8. The transition of the lubricant from the engine-fixed cylinder head 8 to the rotating camshaft 6 is realized usually by known rotary transmitters. This typically involves a ring groove 64 of the outer casing surface of the camshaft 6. The ring groove 64 is enclosed by a corresponding cylindrical casing surface 65 of the cylinder head 8, to which a pass borehole 66 oriented in the axial direction toward the ring groove 64 leads out of the lubricant gallery. The pass borehole 66 can pass through the casing surface 65, as shown in FIG. 11, in the radial direction or can pass through this surface, for example, tangentially.

A rotary transmitter can be arranged in a radial bearing for the camshaft 6 or on a separate shoulder. For the latter, however, due to the usually larger radial gap, often sealing rings 67, 68, for example, a steel sealing ring, cast-iron sealing ring, or plastic sealing ring, are required. In an arrangement of the rotary transmitter in a radial bearing of the camshaft 6 it is to be taken into account that the bearing width is reduced by the width of the ring groove.

In another embodiment, ring grooves can be constructed fixed to the cylinder head, for example, in the bearing, the bearing bridge, or an installed bearing bushing. In the camshaft, no ring grooves 64 are required.

The use of a rotary transmitter described above causes a continuous flow of lubricant from the cylinder head 8 into the camshaft 6 due to the peripheral ring groove and the radial boreholes 69, which connect the ring groove 64 to the borehole 46.

For a special construction, the pass borehole 66 and the ring groove 64 are arranged offset relative to each other in the axial direction, by which, in the transfer of the lubricant from the pass borehole 66 to the ring groove 64, a type of throttle is created, whose opening cross section becomes smaller the greater the offset in the axial direction between the pass borehole 66 and ring groove 64. A throttle effect can also be achieved for a relatively large diameter of the pass borehole 66 and a larger width of the ring groove 64, so that no small boreholes or grooves, which are sensitive to contaminants and production, have to be created.

According to another special construction, lubricant is fed via a cyclical lubricant supply. In such a case, the ring groove 64 is left out, so that a lubricant connection between the pass borehole 66 and the boreholes 69 is given only for rotational positions of the camshaft 6, for which the boreholes 66, 69 align with each other or overlap. If increased transfer times are desired, then the transition region between the pass borehole 66 and borehole 69 of the cylinder head 8 or the casing surface of the camshaft 6 can have a groove running through a partial extent, so that a transfer from the pass borehole 66 to the borehole 69 is possible as long as these boreholes 66, 69 are connected to each other by the groove. In addition, through the construction of the width profile of the groove, there can be a variable transfer of the lubricant. Thus, a volume flow and mass flow of the lubricant can be given structurally and cyclically. Furthermore, a pulsing lubricant flow can be realized, which results in fluctuations in pressure that can be used, for example, for better mixing and wetting of the lubricating positions with the lubricant. Furthermore, through pulsing lubricant flows, the risk of blockages can be reduced, for example, for diaphragms or throttles. If such lubricant pulses lead to pulse oscillations in the lubricant cycle, then a non-return valve can be arranged in the lubricant circuit, in particular, in the region of the cylinder head 8, in the region of the camshaft, and/or in the gear drive.

Figure 12:
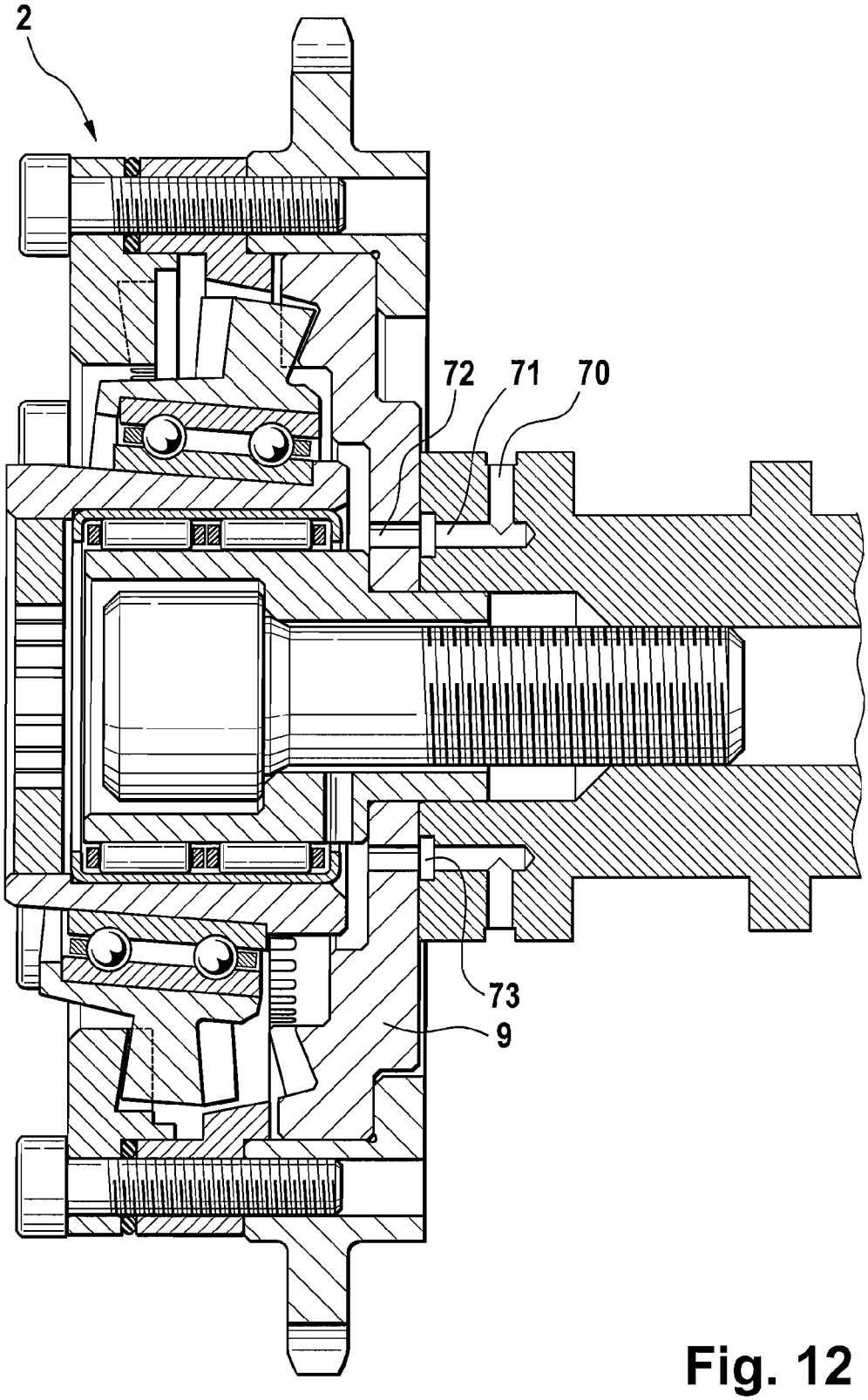

FIG. 12 shows an embodiment, in which lubricant is fed via a radial blind borehole 70, an axial, end-face blind borehole 71 of the camshaft opening into the blind borehole 70, and a pass borehole 72 of the housing 9. Assembly is simplified when a peripheral ring groove 73 is provided in the transition region between the boreholes 71 of the camshaft and the boreholes 72 of the housing 9, by which, during assembly, the boreholes 71, 72 do not have to be aligned coaxial to each other.

Figure 9:
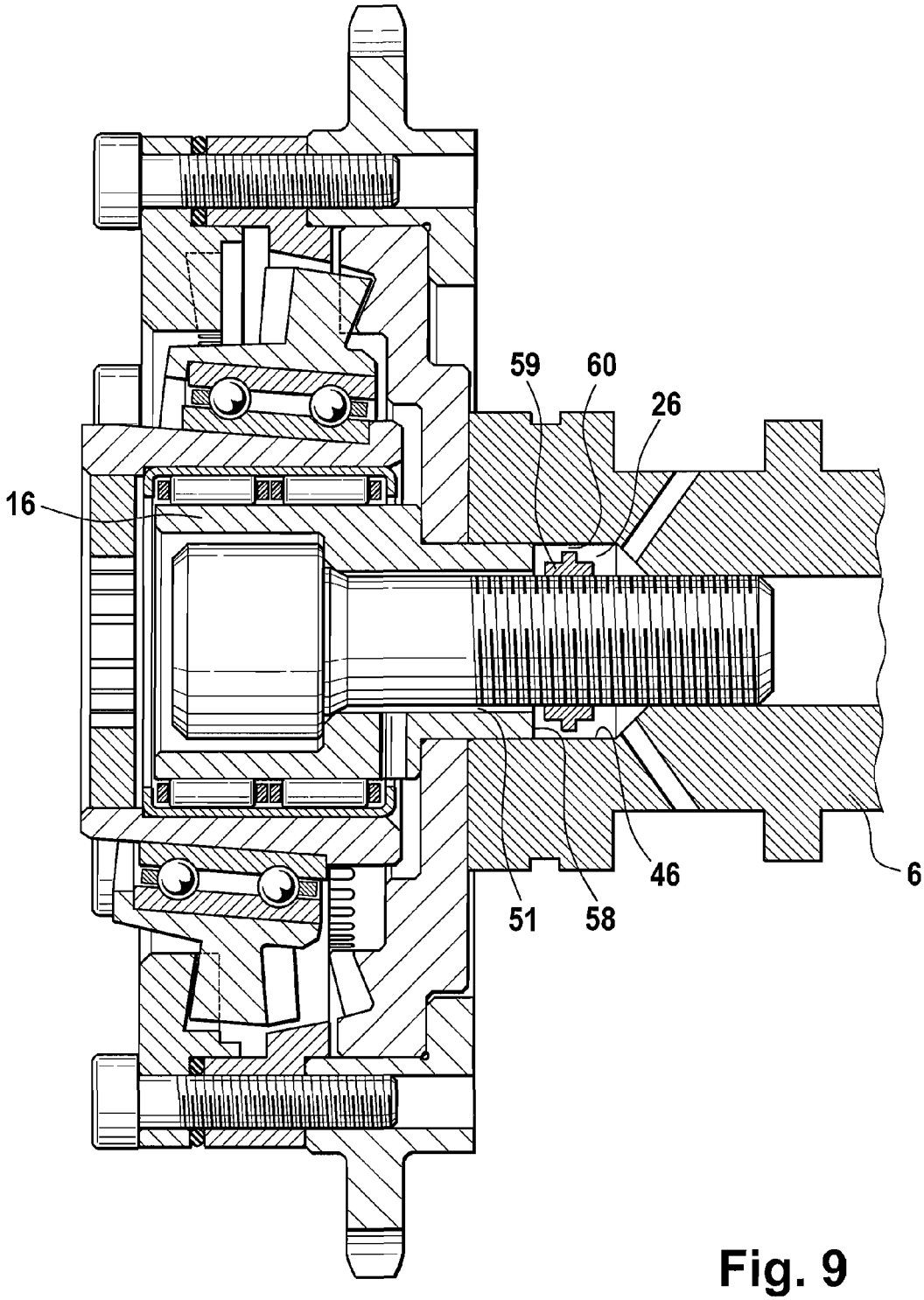
Figure 13:
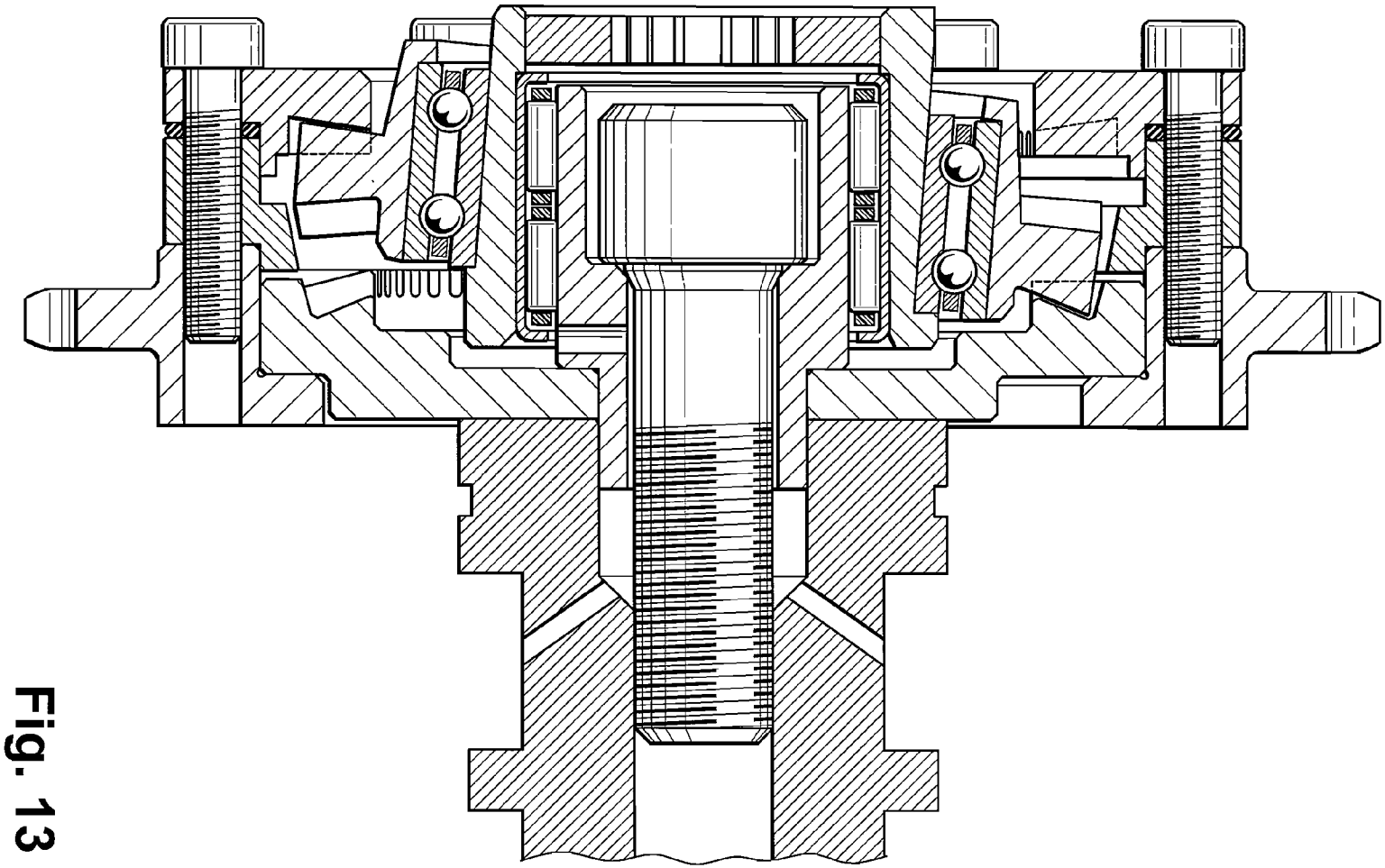

FIG. 13 shows an embodiment, which corresponds essentially to the embodiment according to FIG. 9, wherein, however, no flow element 59 is provided.

Figure 14:
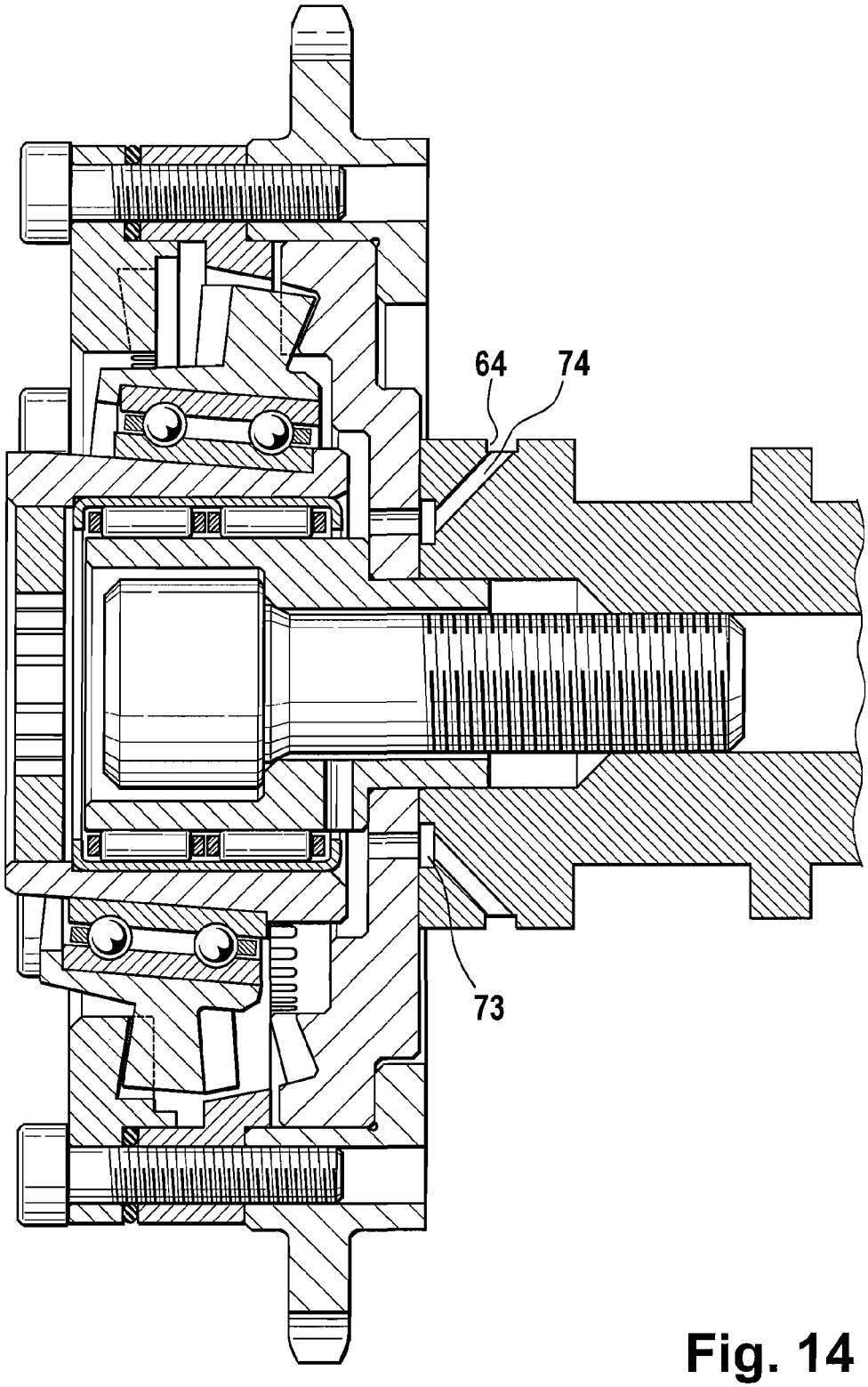

FIG. 14 shows an embodiment, in which the ring groove 64 is connected directly to the ring channel 73 via a borehole 74 inclined relative to the longitudinal axis 21-21 and the transverse axis.

Figure 15:
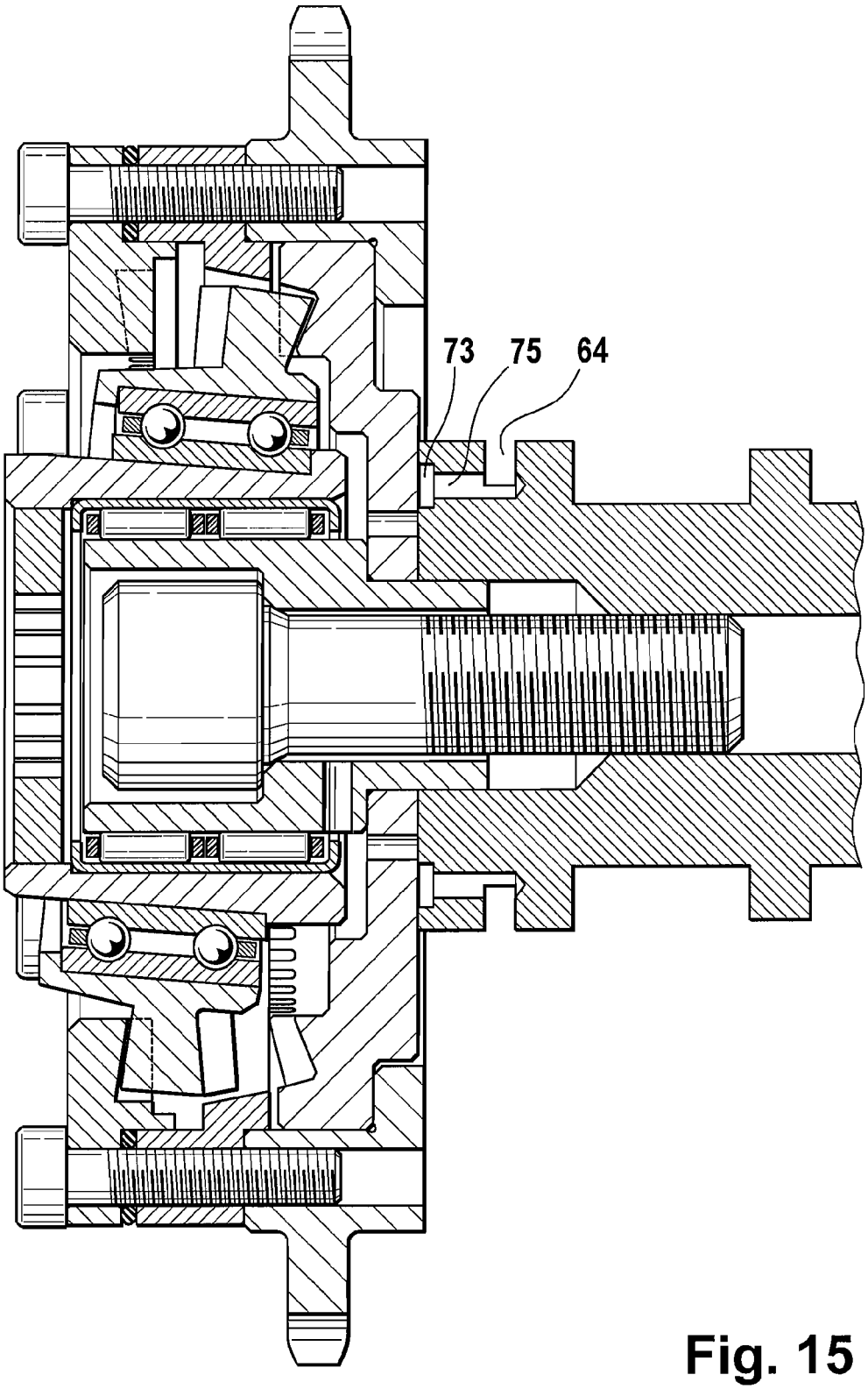

For the embodiment shown in FIG. 15, the direct connection of the ring channel 73 and the ring groove 64 is realized via a borehole 75, which is formed on the end face in the camshaft and which opens into the ring groove 64 and which is drilled through the ring channel 73.

In addition to the structural measures for constructing the flow cross sections in the cylinder head and also in the camshaft, the flow ratios in the lubricant circuit in the gear drive can be influenced. Here, the supply borehole can be throttled through the use of a throttle or diaphragm. Alternatively or additionally, the throttling of the discharge through a rear-side closing of the gear drive, for example, with a sheet-metal cover, is possible, which forms, together with the adjustment shaft, a ring-shaped gap, in particular, with a gap height in the range from 0.1 to 2 mm.

Figure 16:
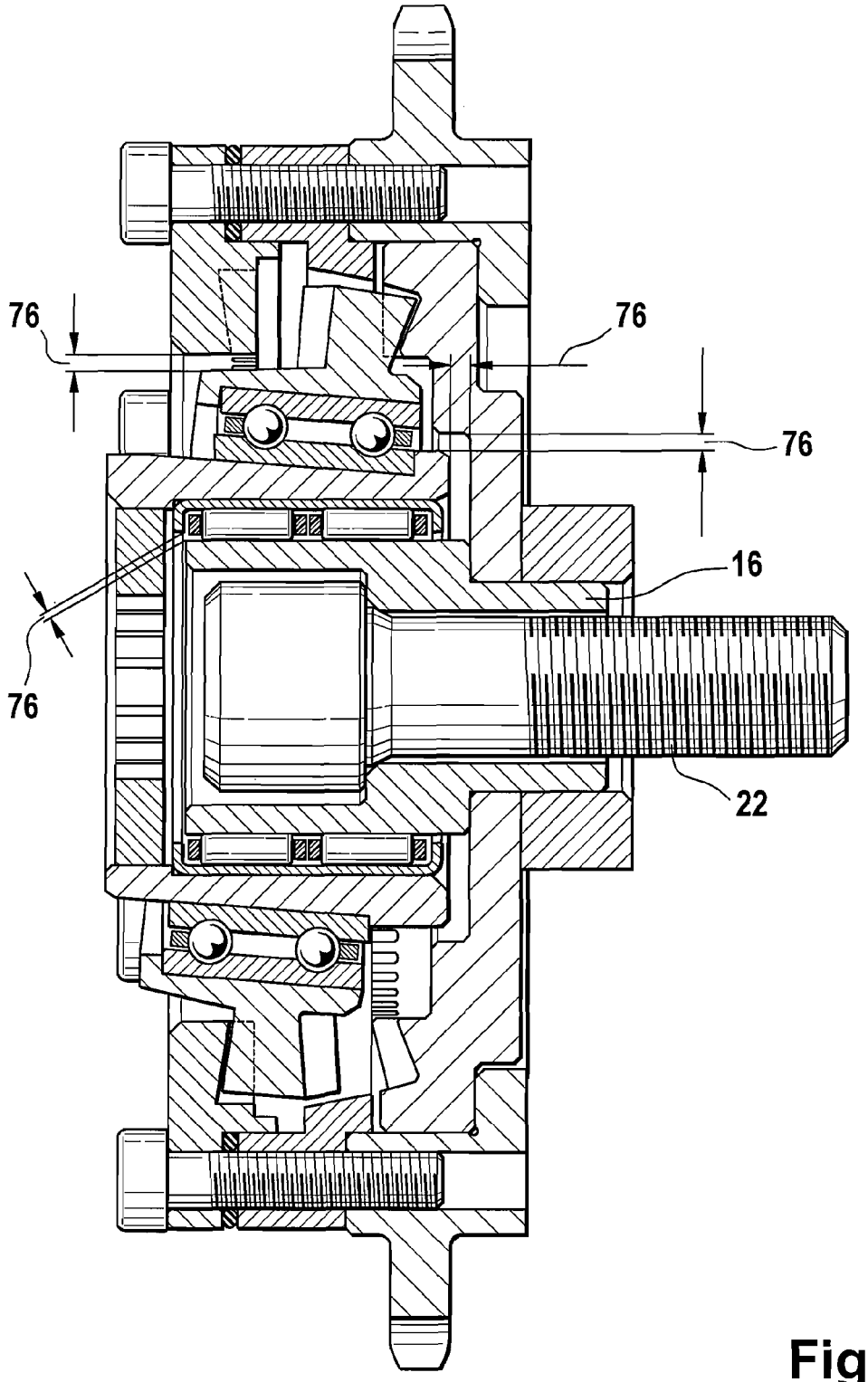

In addition, it is possible to use bearings in the gear drive, which are equipped with sealing elements. According to FIG. 16, a ring channel between the hollow shaft 16 and central screw 22 has a ring width in the range from 0.2 to 1 mm. The radial connection boreholes between this flow channel and the inner space of the gear drive advantageously have a diameter between 0.5 and 3 mm. Additional influences or throttles or diaphragms can be realized by setting the axial and/or radial gaps 76, which can be set structurally and which form flow cross sections or diaphragms or throttles for the lubricant.

Figure 17:
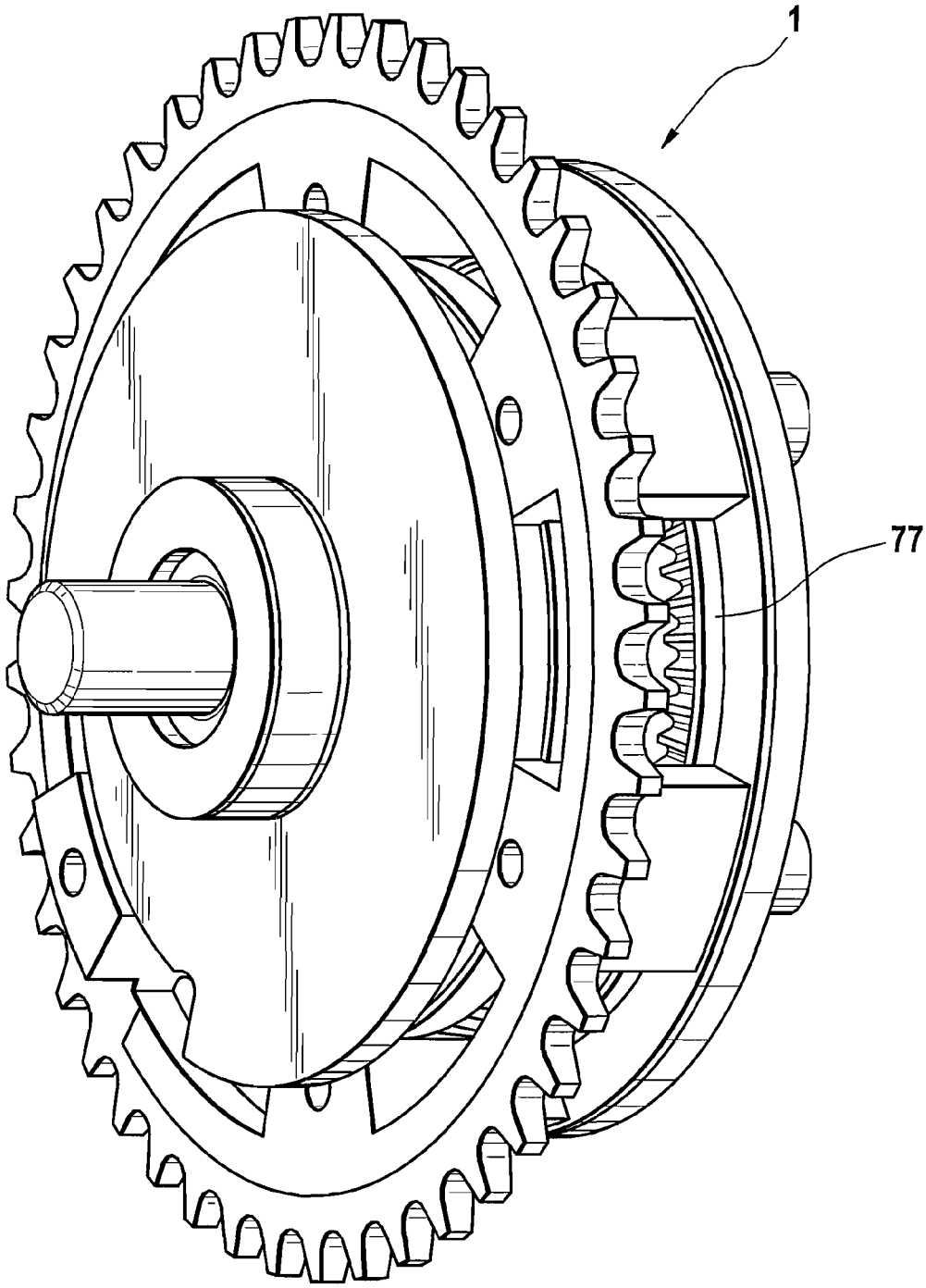

According to another construction of a camshaft adjuster 1, the outer casing surface of the housing 9 has recesses or windows 77, which can be distributed uniformly or non-uniformly in the peripheral direction, cf. FIG. 17.

Figure 18:
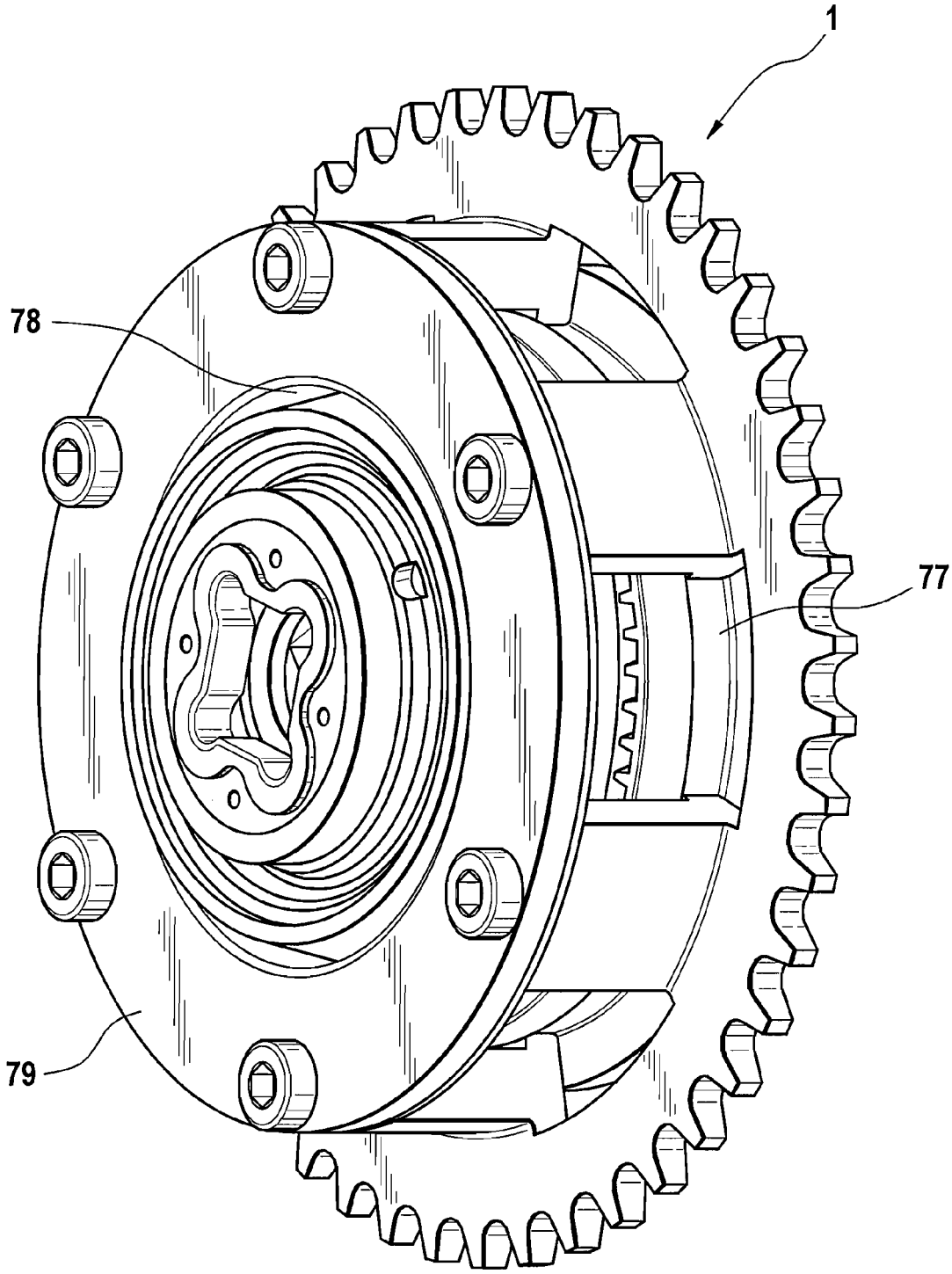
Figure 19:
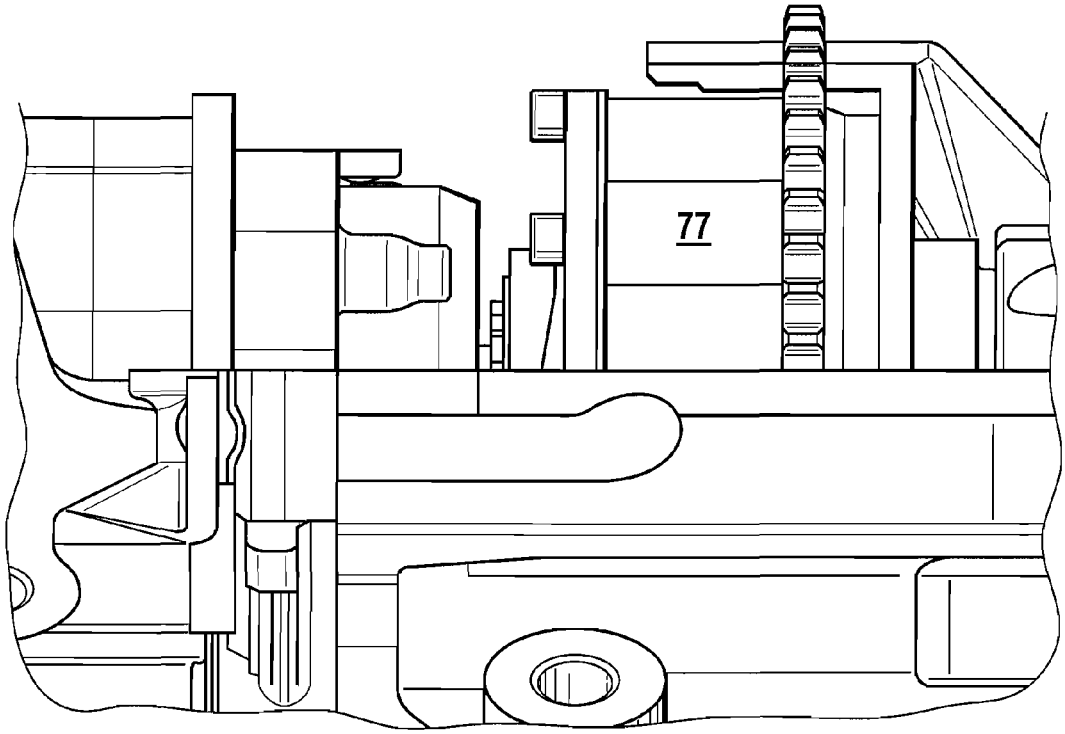

FIG. 18 shows additional options for the arrangement of recesses or openings 78 in the region of one end face of the camshaft adjuster 1. A transmission of the lubricant via the camshaft can be eliminated if a lubricant is fed through the openings 78, 77 to the gear drive 2. For example, the lubricant can be fed via a lubricant injector through the openings 77, 78. Such a lubricant injector can be fixed to the cylinder head or arranged on a timing case. In the simplest case, a lubricant injector can involve only one lubricant borehole, from which a fine lubricant stream is discharged and which occurs at a point outside of the gear drive or within the gear drive, for example, through the openings 77, 78. In particular, such a point can lie as close as possible to the rotational axis in the interior of the gear drive. Due to the centrifugal force acting on the lubricant in the rotating system, the lubricant is distributed outward to the lubricating positions, for example, to a bearing and/or to the toothed section.

In addition, through the arrangement of the openings 77, 78 of the gear housing, the lubricant can be sprayed directly onto a toothed section or other lubricating positions. It is also conceivable that the spraying with lubricant is combined with the lubricant supply of other engine components, for example, a chain or a tensioner. It is also conceivable that a point or a surface outside of the gear drive 2 is sprayed with the lubricant. Lubrication is then guaranteed through the rebounding or reflected lubricant or a lubricant mist generated in this way.

According to an alternative construction, a lubricant supply can be realized by the lubricant mist, which is already present in a timing case and which can penetrate into the camshaft adjuster through the openings 77, 78.

Figure 20:
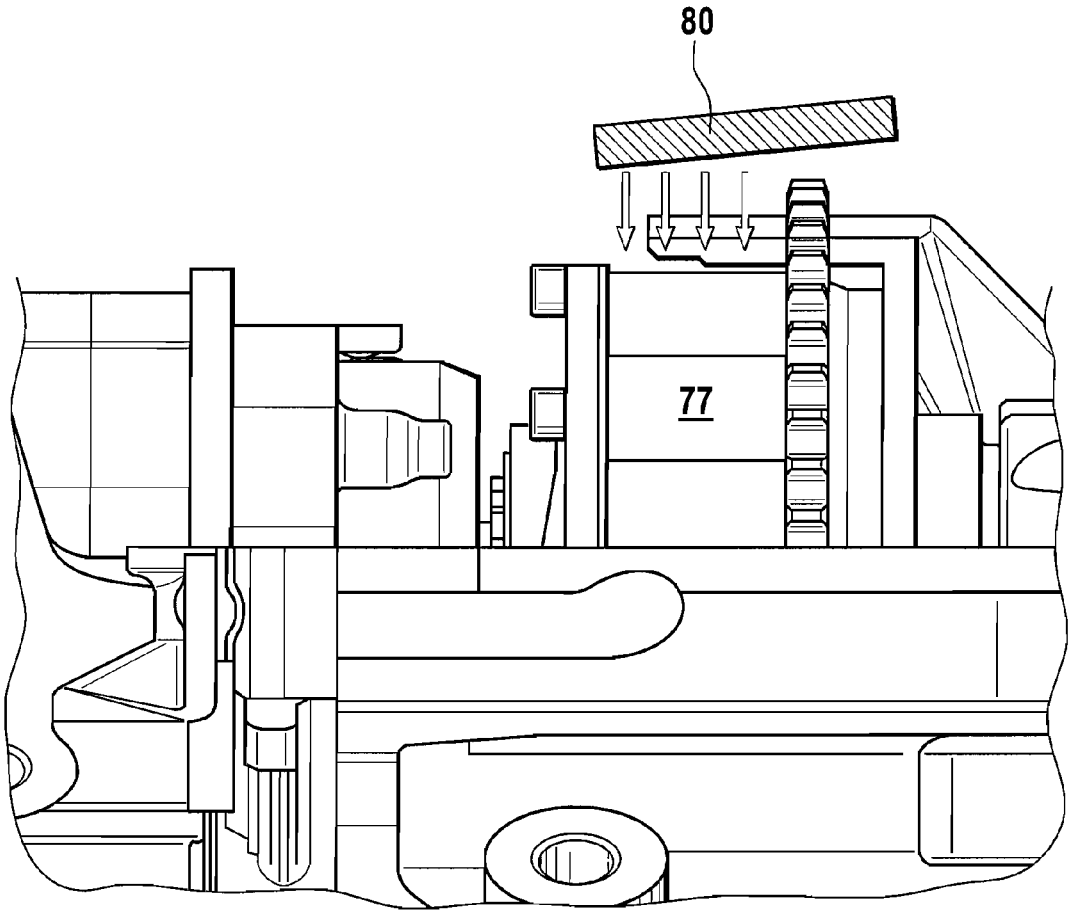

In another construction of a lubricant supply according to FIG. 20, outside of the gear drive there is a drop plate 80, on which the lubricant mist condenses and drips. Alternatively or additionally, special drop lubricant nozzles can be provided, which are oriented selectively in the direction of the openings 77, 78.

To reliably guarantee functioning for lubrication with a lubricant mist, mist lubricant droplets, or with a lubricant stream, even at low temperatures of the lubricant or for a cold start, the lubricating positions, for example, slide bearings and/or toothed sections, are to be equipped with emergency-running properties. Such emergency-running properties can be guaranteed, for example by a coating of the functional partners or by forming lubricant reservoirs.

In particular, the lubricant reservoirs are provided by microscopically or macroscopically small pockets at the lubricating positions, in which lubricant can be stored for a cold start or for low lubricant temperatures. Better emergency-running properties can also be provided, advantageously, when roller bearings are provided at the bearing positions as much as possible.

Furthermore, for lubrication, oil dripping from an oiled traction element (timing chain) can also be used, which passed through an opening of the housing. Under some circumstances, the traction element is lubricated by wobble or spray oiling or by stripping oil from oiled chain tensioners or deflection rails. A part of the oil supplied by the chain can drops above the drive wheel (chain wheel) of the gear drive and can thus be led into openings of the gear drive lying underneath. In addition, it is possible to feed oil through the capillary effect to the gear drive or to drip positions lying above the gear drive. It is also possible that oil is "blown," for all practical purposes, to the lubricating position, by air currents resulting, e.g., from the drive movement of the control drive or adjustment parts.

LIST OF REFERENCE SYMBOLS

1 Camshaft adjuster
2 Gear Drive
3 Drive wheel
4 Adjustment shaft
5 Driven shaft
6 Camshaft
7 Electric motor
8 Cylinder head
9 Housing
10 Sealing element
11 Sealing element
12 Coupling
13 Eccentric shaft
14 Bearing element
15 Wobble plate
16 Hollow shaft
17 Bearing element
18 Driven conical gear wheel
19 Bearing
20 Drive conical gear wheel
21 Longitudinal axis
22 Central screw
23 Lubricating position
24 Lubricating position
25 Feed recess
26 Flow channel
27 Flow channel
28 Casing surface
29 Casing surface
30 Borehole
31 Reservoir
32 Pump
33 Filter
34 Outlet opening
35 Filter element
36 Inner space
37 Dead space
38 Wall
39 Outlet opening
40 Outlet opening
41 Diaphragm
42 Throttle
43 Diaphragm
44 Throttle
45 Borehole
46 Blind borehole
47 Chamfer
48 Groove
49 Borehole
50 Borehole
51 Flow channel
52 Borehole
53 Transfer region
54 Edge
55 Transverse surface
56 Edge
57 Casing surface
58 End face
59 Flow element
60 Ring gap
61 Groove
62 Projection
63 Ring gap
64 Ring gap
65 Casing surface
66 Pass borehole
67 Sealing ring
68 Sealing ring
69 Borehole
70 Blind borehole
71 Blind borehole
72 Pass borehole
73 Ring channel
74 Borehole
75 Borehole
76 Gap
77 Opening
78 Opening
79 End face
80 Drop plate
81 Intermediate space
82 Sub-region
83 Sub-region
84 Flow channel

What is claimed is:

1. A camshaft adjuster for an internal combustion engine for adjusting a relative angle position between a drive element and a driven element, the camshaft adjuster comprising a gear drive connecting the drive element and the driven element and a flow channel is provided for directing a flow of a lubricant, the flow of the lubricant is influenced by a plurality of flow elements connected in series or parallel, at least one of the flow elements comprises a diaphragm or throttle that is inserted into the flow channel of the camshaft adjuster.

2. The camshaft adjuster according to claim 1, wherein the flow element is arranged in an inlet region of the lubricant into the gear drive or in an outlet region of the lubricant from the gear drive.

3. The camshaft adjuster according to claim 1, wherein the flow element is connected to the flow channel with a positive-fit, friction-fit, or material-fit connection.

4. The camshaft adjuster according to claim 1, wherein the flow element is formed with a plastic or an elastomer.

5. The camshaft adjuster according to claim 1, wherein the flow channel has a circular ring-shaped cross section in a region in which the flow element is inserted.

6. The camshaft adjuster according to claim 5, wherein the flow channel is formed between an outer surface of a central screw screwed into the camshaft on an end face and a camshaft-fixed inner surface.

7. The camshaft adjuster according to claim 1, wherein the flow element is pressed elastically in a radial direction and under radial pressure against a boundary of the flow channel.

8. The camshaft adjuster according to claim 1, wherein a filter element is arranged upstream of the flow element.

9. The camshaft adjuster according to claim 1, wherein the flow element comprises a change in cross section of the flow channel perpendicular to a flow direction of the lubricant.

10. The camshaft adjuster according to claim 1, wherein the flow element comprises a change in cross section of the flow channel in a circumferential direction relative to a flow direction of the lubricant.

11. The camshaft adjuster according to claim 1, wherein the plurality of the flow elements are connected in series.

12. The camshaft adjuster according to claim 1, wherein flow properties of the flow element are changeable during operation of the internal combustion engine.

13. The camshaft adjuster according to claim 12, wherein the flow properties of the flow element are changeable as a function of temperature.

14. The camshaft adjuster according to claim 12, wherein the flow properties of the flow element are changeable as a function of a rotational speed.

15. The camshaft adjuster according to claim 14, wherein the flow properties of the flow element are changeable in a motion-controlled manner by rotation of the camshaft, the camshaft adjuster, or the gear drive.

16. The camshaft adjuster according to claim 12, wherein the flow element can be closed completely.

17. A camshaft adjuster for an internal combustion engine for adjusting a relative angle position between a drive element and a driven element, the camshaft adjuster comprising a gear drive connecting the drive element and the driven element and a flow channel is provided for directing a flow of a lubricant the flow of the lubricant is influenced by a flow element, which forms a diaphragm or throttle that is inserted into the flow channel of the camshaft adjuster, wherein the driven element is a camshaft and the flow channel includes first and second flow channels, and between a central screw and a central, end-face recess of the camshaft, a hollow cylinder-shaped intermediate space is formed, having a first partial region that forms the first flow channel and in which, in an outer, second partial region, a hollow shaft is arranged for formation of the second flow channel, wherein the second flow channel has a smaller flow cross section than the first flow channel, and the diaphragm or throttle is formed by at least one projection in the first flow channel between the hollow shaft and central screw or between the hollow shaft and camshaft.

18. A camshaft adjuster for an internal combustion engine for adjusting a relative angle position between a drive element and a driven element, the camshaft adjuster comprising a gear drive connecting the drive element and the driven element and a flow channel is provided for directing a flow of a lubricant the flow of the lubricant is influenced by a flow element, which forms a diaphragm or throttle that is inserted into the flow channel of the camshaft adjuster, wherein the driven element is a camshaft, and between a central screw and a central, end-face recess of the camshaft, a hollow cylinder-shaped intermediate space is formed, wherein the camshaft has a radial groove, the hollow cylinder-shaped intermediate space forms the flow channel in a first partial region, in an outer, second partial region and on an inside of the radial groove in a radial direction, a hollow shaft surrounding the central screw is arranged, and the radial groove and the flow channel are connected to each other by a diaphragm, which is formed between an end face of the hollow shaft and an inner casing surface of the camshaft.

19. The camshaft adjuster according to claim 18, wherein the groove has an outer dead space in the radial direction.

20. A camshaft adjuster for an internal combustion engine for adjusting a relative angle position between a drive element and a driven element, the camshaft adjuster comprising a gear drive connecting the drive element and the driven element and a flow channel is provided for directing a flow of a lubricant the flow of the lubricant is influenced by a flow element, which forms a diaphragm or throttle that is inserted into the flow channel of the camshaft adjuster, wherein the lubrication is provided from a cylinder head-fixed component and the driven element is a camshaft and the cylinder head-fixed component has at least one outlet opening and the camshaft has at least one inlet opening, wherein, in a transfer region from the outlet opening to the inlet opening, a throttle or diaphragm is created in such a way that the inlet opening and the outlet opening do not align with each other, but instead are arranged offset relative to each other.

21. The camshaft adjuster according to claim 20, wherein one opening of the inlet opening and the outlet opening is constructed as a groove extending in a circumferential direction and the other opening of the inlet opening and the outlet opening is constructed as a borehole.

22. The camshaft adjuster according to claim 20, wherein the gear drive is constructed as a wobble plate gear.

* * * * *